US010314355B1

(12) United States Patent
Gallo

(10) Patent No.: US 10,314,355 B1
(45) Date of Patent: Jun. 11, 2019

(54) PANEL AND SYSTEM FOR LOAD CARRIAGE AND PROTECTION FOR TACTICAL AND NON-TACTICAL GARMENTS

(71) Applicant: Massimo Alex Gallo, Plano, TX (US)

(72) Inventor: Massimo Alex Gallo, Plano, TX (US)

(73) Assignee: Raine, INC., Anderson, IN (US)

( * ) Notice: Subject to any disclaimer, the term of this patent is extended or adjusted under 35 U.S.C. 154(b) by 0 days.

(21) Appl. No.: 15/827,999

(22) Filed: Nov. 30, 2017

(51) Int. Cl.

| | |
|---|---|
| ***A41F 1/00*** | (2006.01) |
| ***A45F 5/02*** | (2006.01) |
| ***A47G 25/90*** | (2006.01) |
| ***A41D 13/00*** | (2006.01) |
| *F41H 1/02* | (2006.01) |

(52) U.S. Cl.
CPC ..... *A41F 1/00* (2013.01); *A41D 13/0012* (2013.01); *A45F 5/022* (2013.01); *A47G 25/90* (2013.01); *A41D 2400/44* (2013.01); *F41H 1/02* (2013.01)

(58) Field of Classification Search
CPC .. A41F 9/002; A41F 1/00; A41D 1/04; A41D 13/0012
See application file for complete search history.

(56) References Cited

U.S. PATENT DOCUMENTS

| | | | | |
|---|---|---|---|---|
| 6,185,738 | B1 * | 2/2001 | Sidebottom | F41H 1/02 2/102 |
| 6,769,137 | B2 * | 8/2004 | D'Annunzio | F41H 1/02 2/102 |
| 7,020,897 | B2 * | 4/2006 | Johnson | F41H 1/02 2/102 |
| 8,490,212 | B1 * | 7/2013 | Asher | A41D 1/04 2/2.5 |
| 8,595,862 | B2 * | 12/2013 | Storms, Jr. | A41D 13/05 2/102 |
| 2008/0086846 | A1 * | 4/2008 | Wemmer | A41D 27/20 24/3.1 |
| 2014/0332572 | A1 * | 11/2014 | Buerck | F41H 1/02 223/111 |

* cited by examiner

*Primary Examiner* — Tajash D Patel
(74) *Attorney, Agent, or Firm* — Sul Lee

(57) ABSTRACT

A panel covers a release mechanism of a garment and enables the mounting of pouches and equipment thereon. The panel includes a reinforcement structure, a fabric having mounting slots wound over the reinforcement structure, and a securing mechanism that secures the panel to the release mechanism of the garment. Also, a garment may include a built-in panel that covers a release mechanism and enables mounting of pouches and equipment thereon. The garment includes a main garment portion, a release mechanism extending from an open end of the garment, and the built-in panel incorporated into the main garment portion.

20 Claims, 21 Drawing Sheets

PANEL AND SYSTEM FOR LOAD CARRIAGE AND PROTECTION FOR TACTICAL AND NON-TACTICAL GARMENTS

TECHNICAL FIELD

The present disclosure relates generally to the field of load-bearing tactical and non-tactical garments, personally worn armor vests, armor carriers, plate carriers, chest rigs, apparel, load bearing gear, and/or vests for carrying items and particularly to an attachment panel that may be fastened or fixed on a cummerbund of an armor carrier and/or a cummerbund and/or load bearing gear with the attachment panel made into it, that increases load carrying capability and/or armor protection that does not interfere with the emergency and/or standard donning and/or doffing of the garment.

BACKGROUND ART

A defense unit that includes military, anti-terrorist operators and police and/or other operators that have to perform high risk missions need to be provided armor and load bearing gear equipped with ammunition and other equipment. Items can include bullets, gun magazines and hand grenades, water containers etc. that are required while in combat against the enemy. Equipment may include communication means, navigation means, binoculars, portable lighting units and whatever other items that can be foreseen to be of assistance in a mission.

Further, apart from ammunition and the equipment, the operators may want to carry along first aid kits that include medicine and surgical tools required in state of emergency. Thus, some operators may need to carry multiple items mentioned above for a mission. To carry these items, vests, carriers and chest rigs can be designed with pouches. Pouches are fabricated of cotton canvas and/or nylon fabrics to carry a particular size or type of military item. Typically, a pouch has an open mouth which is covered with a flap using a buckle, hook and loop closures and/or any other fastening technique. The pouches are mounted on the waist belt, backpacks and/or garment worn by the operator.

To carry these items, carriers, and chest rigs are also designed with Pouch Attachment Ladder System (PALS) grid also referred to as a MOLLE (Modular Lightweight Load-carrying Equipment) grid, is a grid of webbing used to attach smaller equipment onto load-bearing platforms, such as vests and backpacks. PALS/MOLLE can be used to attach items such as holsters, magazine pouches, radio pouches, knife sheathes, and other gear. A wide variety of pouches are commercially available, allowing operators to customize their kit. PALS/MOLLE consists of webbing sewn onto the load-bearing equipment and corresponding webbing and straps on the attachment. The straps are interwoven between the webbing on each of two pieces and finally snapped and/or secured into place, making for a very secure fit which can be detached with moderate effort. New types MOLLE/PALS grids are cut out of a single piece fabric rather than webbing straps sewn onto fabric can also be used.

The load carrying armor vest and carrier is designed like a strength training weighted vest having multiple pockets for mounting pouches for carrying various items. The pockets can be provided on the entire surface of the armor vest and/or in combination with PALS/MOLLE or vests can be made with only PALS/MOLLE. The modern armor vest can also include a cummerbund that is specifically designed to carry more equipment and/or body armor. Cummerbunds can also help to distribute weight for the vest on some vests and provide more space to carry added gear and equipment.

FIG. 1 illustrates a load carrying armor carrier (100), in accordance with an embodiment of a prior art. As shown in FIG. 1, the load carrying armor carrier (100) contains multiple slots (102) and/or cuts on the entire surface of the armor carrier (100), including the cummerbund (104), to allow mounting of pouches to any corresponding MOLLE/PALS slot on the surface of the carrier. Although the slots (102) are illustrated as being horizontal in the figures, this is merely for exemplary purposes. According to an embodiment any mention of slots (102) in the present disclosure may be horizontal and/or vertical and/or in a plurality of angles with a plurality of shapes for the slots. The slots (102) are typically provided with cuts in order to maintain the strength and load bearing capacity such that the cuts do not tear off while mounting a pouch.

However, a problem that occurs with a typical load carrying armor carrier (100) is that the cummerbund (104) is fastened with the armor carrier (100) using a mechanical release mechanism (106) such as a buckling arrangement and/or a Tubes™ release apparatus, embodiments of which are disclosed in detail in a US Patent Publication No. 2014/0332572 that is hereby incorporated by reference in the present application. Further, the release mechanism (106) includes a plastic material fastener connected to the cummerbund (104) using a fabric, webbing and/or nylon connector stitched with the cummerbund (104). The release mechanism (106), being a plastic part, does not allow mounting of any pouches on it, thereby decreasing the load carrying capacity of the armor carrier, particularly at places that can easily be reached by the user. Another problem is that because both sides of the armor carrier are covered by the release mechanism, these areas can be rendered weak and/or unprotected. However, the release mechanism (106) is to be held on the abdomen area of the body and thus should not be left unprotected.

In light of the discussion above, there is clearly a need in the art for a better load bearing solution that does not suffer from the above mentioned deficiencies.

SUMMARY

According to an embodiment, a panel is configured to cover a release mechanism of a garment and to enable mounting pouches and equipment thereon. The panel includes a reinforcement structure; a fabric wound over the reinforcement structure, the fabric comprising a plurality of mounting slots; and a first securing mechanism configured to secure the panel to the release mechanism of the garment such that the panel enables mounting of pouches and equipment over an area covering the release mechanism.

According to an embodiment, the panel includes a vertical cavity for allowing the first securing mechanism to be tunneled through the outer face of the panel.

According to an embodiment, the panel includes a plurality of securing slots on the inner face of the panel for allowing passage of the first securing mechanism through the plurality of securing slots.

According to an embodiment, the panel includes a second securing mechanism for tunneling through the vertical cavity and fastening to the release mechanism to restrain the panel from folding back.

According to an embodiment, the panel includes a loop on an edge of the panel for allowing passage of a cord that is operatively coupled to the release mechanism.

According to an embodiment, the reinforcement structure comprises at least one elongated bar, and the panel includes at least one tunnel-ended strip for fastening the at least one elongated bar to the garment, each tunnel-ended strip comprising a tunnel portion configured to wrap around a free end of an elongated bar that is extending out of the panel; and at least one strip configured to fasten to the garment.

According to an embodiment, the plurality of mounting slots form a MOLLE grid.

According to an embodiment, the plurality of mounting slots comprise one of sewn webbings and cut slots.

According to an embodiment, the panel includes a protective insert underneath the fabric, the protective insert being composed of one of a rigid and semi-rigid material.

According to an embodiment, a garment includes a built-in panel configured to cover a release mechanism of a garment and to enable mounting pouches and equipment thereon. The garment comprises a main garment portion comprising a plurality of open end and a first plurality of mounting slots on an outer surface proximate to each of the at least one open end; a release mechanism extending from an open end of the main garment portion and configured to maintain the garment in a closed state when donned and enable quick release to an opened state when being doffed; and the built-in panel incorporated into and extending from the main garment portion, the built-in panel comprising a fabric comprising a second plurality of mounting slots. The built-in panel also covers the release mechanism such as to enable mounting of pouches and equipment over an area covering the release mechanism.

According to an embodiment, the built-in panel further comprises a reinforcement structure underneath the fabric.

According to an embodiment, the garment includes a securing mechanism that fastens the release mechanism to the built-in panel such that the built-in panel is restrained from folding back.

According to an embodiment, the garment includes a protective insert underneath the fabric of the built-in panel, the protective insert being composed of one of a rigid and semi-rigid material.

According to an embodiment, the garment includes a loop on an edge of the built-in panel for allowing passage of a cord that is operatively coupled to the release mechanism.

According to an embodiment, the first plurality of mounting slots of the main garment portion and the second plurality of mounting slots of the built-in panel form a continuous MOLLE grid.

According to an embodiment, the first and second pluralities of mounting slots comprise at least one of sewn webbings and cut slots.

According to an embodiment, the release mechanism comprises at least one molded passage to allow the securing mechanism to pass through.

According to an embodiment, the garment is a cummerbund, a vest, a carrier, or a chest rig.

According to an embodiment, the first securing mechanism may be a strap or a zip tie.

BRIEF DESCRIPTION OF THE ACCOMPANYING DRAWINGS

So that the manner in which the above recited features of the present disclosure can be understood in detail, a more particular description of the disclosure, briefly summarized above, may be referred by embodiments, some of which are illustrated in the appended drawings. It is to be noted, however, that the appended drawings illustrate are merely exemplary and are therefore not to be considered limiting of its scope, for the disclosure may lend itself other equally effective embodiments.

These and other features, benefits, and advantages of the present disclosure will become apparent by reference to the following figures, with like reference numbers referring to like structures across the views, wherein.

DETAILED DESCRIPTION

Figure 1:
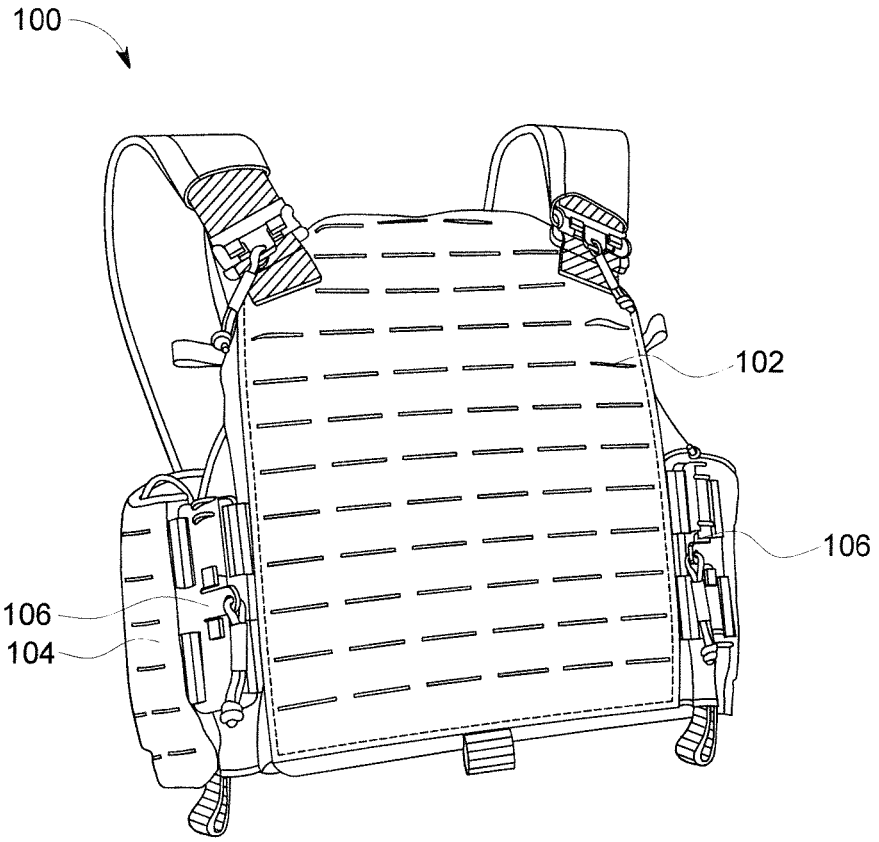
FIG. 1 PRIOR ART
FIG. 1 illustrates an armor carrier, in accordance with an embodiment of the prior art.

While the present disclosure is described herein by way of example using embodiments and illustrative drawings, those skilled in the art will recognize that the disclosure is not limited to the embodiments of drawing or drawings described, and are not intended to represent the scale of the various components. Further, some components that may form a part of the disclosure may not be illustrated in certain figures, for ease of illustration, and such omissions do not limit the embodiments outlined in any way. It should be understood that the drawings and detailed description thereto are not intended to limit the disclosure to the particular form disclosed, but on the contrary, the disclosure is to cover all modifications, equivalents, and alternatives falling within the scope of the present disclosure as defined by the appended claim. As used throughout this description, the word "may" is used in a permissive sense (i.e. meaning having the potential to), rather than the mandatory sense, (i.e. meaning must). Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the like is included in the specification solely for the purpose of providing a context for the present disclosure. It is not suggested or represented that any or all of these matters form part of the prior art base or were common general knowledge in the field relevant to the present disclosure.

In this disclosure, whenever a composition or an element or a group of elements is preceded with the transitional phrase "comprising", it is understood that we also contemplate the same composition, element or group of elements with transitional phrases "consisting of", "consisting", "selected from the group of consisting of, "including", or "is" preceding the recitation of the composition, element or group of elements and vice versa.

The present disclosure is described hereinafter by various embodiments with reference to the accompanying drawing, wherein reference numerals used in the accompanying drawing correspond to the like elements throughout the description. This disclosure may, however, be embodied in many different forms and should not be construed as limited to the embodiment set forth herein. Rather, the embodiment is provided so that this disclosure will be thorough and complete and will fully convey the scope of the disclosure to those skilled in the art. In the following detailed description, numeric values and ranges are provided for various aspects of the implementations described. These values and ranges are to be treated as examples only, and are not intended to limit the scope of the claims. In addition, a number of materials are identified as suitable for various facets of the implementations. These materials are to be treated as exemplary and are not intended to limit the scope of the disclosure.

Embodiments of the present disclosure are directed to an attachment to be fastened on to an end of a cummerbund of a body armor vest, armor carrier, plate carrier and/or tactical/non-tactical ensemble, garment, and/or a cummerbund that incorporates the features of the attachment to address the loss of load carrying capacity due to space taken up by existing closure systems and quick release systems on conventional cummerbunds. For example, the release systems described in U.S. Patent No. US 2014/0332572 A1 are polymer C-shaped clip and pin mechanisms on either side of a cummerbund. The C-shaped clip (female portion) and pin (male portion), being a polymer part, does not contain any cuts and/or pockets for attaching pouches or other equipment. Further, the C-shaped clip and pin together take one or more horizontal inches of area between the cummerbund (104) and carrier, or between open ends of a chest rig, that could otherwise be used to add more slots (102), extend a PALS/MOLLE grid or sew in a permanent pouch. In the embodiments described in the present disclosure, mentions of release mechanism (or release apparatus) refer to either the male or female portion of the release system and/or closure system to which the panel is secured.

As such, embodiments of the present disclosure provide a solution that allows additional pouches and/or equipment over the otherwise unusable space created by the release apparatus areas on each side of the cummerbund by providing an attachment that can be fastened and/or fixed to an existing cummerbund or a cummerbund that incorporates the features of the attachment. The embodiments of the present disclosure do not impede with the opening and/or closing (donning or doffing) of the release apparatus (106), and also do not interfere with any quick release function. Furthermore, embodiments of the present disclosure cover and protect the release apparatus (106) and also help extend the service life of the release mechanism by covering and protecting it from impacts from day-to-day use and the elements (e.g. direct sunlight, UV light, wind, dirt, etc.). Furthermore, composite and/or standalone ballistic and fragmentation protective materials can be used in the attachment to add protection from ballistic and/or fragmentation threats. Embodiments of the present disclosure also increase protection from accidental quick release opening of the release mechanism and can be ambidextrous (in that they can be used on either side of the cummerbund).

Figure 2:
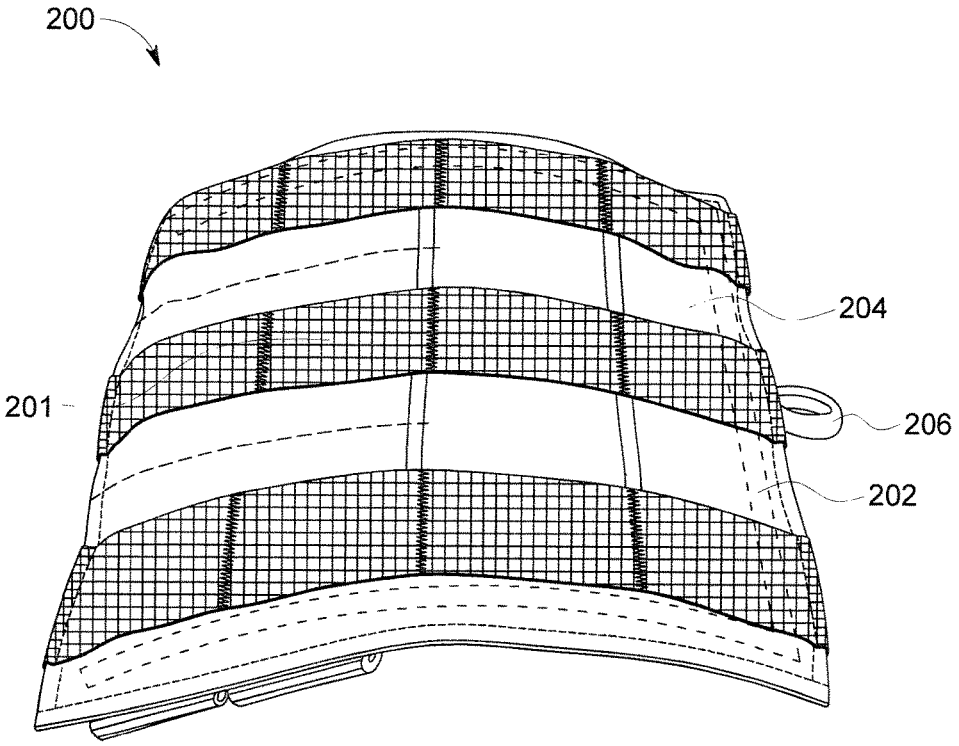
FIG. 2 illustrates an attachment panel, in accordance with an embodiment of the disclosure.

Referring to the drawings, embodiments of the disclosure will now be described in more detail. FIG. 2 illustrates an attachment panel (200), in accordance with an embodiment of the disclosure. As shown in FIG. 2, the attachment panel (200) may be fastened onto a cummerbund (104) of a plate carrier (100) and comprises a reinforcement structure (202) (illustrated in dotted lines) and a fabric (204) wound over the reinforcement structure (202). Further, the fabric (204) wound over the reinforcement structure (202) has a plurality of slots (201) capable of receiving one or more items. According to an embodiment the plurality of slots may be a MOLLE (Modular Lightweight Load-carrying Equipment) grid. Although the slots (201) are illustrated as being horizontal in the figures, this is merely for exemplary purposes. According to an embodiment, any mention of slots in the present disclosure may be horizontal and/or vertical and/or a plurality of angles. The slots (201) may be made of a plurality of geometries and are not limited to solely being made of a straight cut.

MOLLE is an industry term to refer to the way you attach a pouch to something with a compatible MOLLE grid. MOLLE grids can be cut or sewn on with webbing to allow for pouches with MOLLE compatible straps on their backs to be laced/connected to a body armor carrier, back pack or similar that has a compatible MOLLE grid. MOLLE, which stands for Modular Lightweight Load-carrying Equipment was a set of equipment the Army made. However, the term MOLLE stuck as the way to describe how pouches and other gear are attached or fastened to a grid of slots (201). MOLLE may also be referred by its technical name: PALS (Pouch Attachment Ladder System). There are several styles and ways to secure the ends of the webbing for the pouch (e.g., snap fasteners or tucking ends back into the pouch with a sewn in piece of reinforced plastic or using hook/loop materials at each end).

Items that may be stored in the pouches may include but are not limited to one or more of ammunition items, military equipment and medical items. The ammunition items include items such as, but not limited to, bullets, gun magazines and hand grenades etc., that are required while in combat. Military equipment may include equipment such as, but not limited to, communication means, navigation means, binoculars, portable lighting units and whatever other items that can be foreseen to be of assistance in relation to a mission. Medical items may include one or more of, but not limited to, first aid kit and surgical tools. Hydration items to carry water may include, but not limited to, a canteen, bottle, reservoir, and bladder.

In accordance with an embodiment of the disclosure, the attachment panel (200) further comprises a loop (206) adapted to receive an unlocking cord of the release mechanism (106) in a manner that allows axial pull to the unlocking cord of the release mechanism (106). The loop (206) is disposed into the fabric (204) of the attachment panel such that a portion of the loop (206) is inside the attachment panel (200) and the visible portion extends out of the attachment panel (200). The portion that extends out of the attachment panel (200) creates a loop (206) as shown in FIG. 2 that allows the passage of an unlocking cord (720) and/or an extension cord (715) (illustrated in FIG. 7) for the release mechanism (106). According to an embodiment, the loop (206) may be placed anywhere along an edge of the panel (200), such as being centered along the length of the edge, centered between two cut slots (102), centered between two sewn webbing slots (201), centered on a sewn webbing strip, or simply off center. Although not shown here, the attachment panel (200) may be fastened to slots (201) (such as on a MOLLE grid) of a cummerbund (104) or chest rig (1800), as will be described later, or some other tactical or non-tactical garment.

According to embodiments, other release mechanisms may also be used such as Lindnerhof™ buckles, AustriAlpin™ Buckles, FirstSpear® Tubes™ buckles, magnetic buckles, London Bridge Trading quick release buckles, Fidlock buckles, Bushido Tactical Halo Buckles™, Blue Force Gear® quick release buckles, Aspetto® Swift Release buckles, ITW Nexus® side release buckles, National Molding® quick release and side release buckles and/or similar buckles, fixtures, and/or hardware. For the sake of clarity and easy understanding only, Tubes™ buckles is taken as an exemplary fastening arrangement in the description and accompanied drawings.

Figure 3:
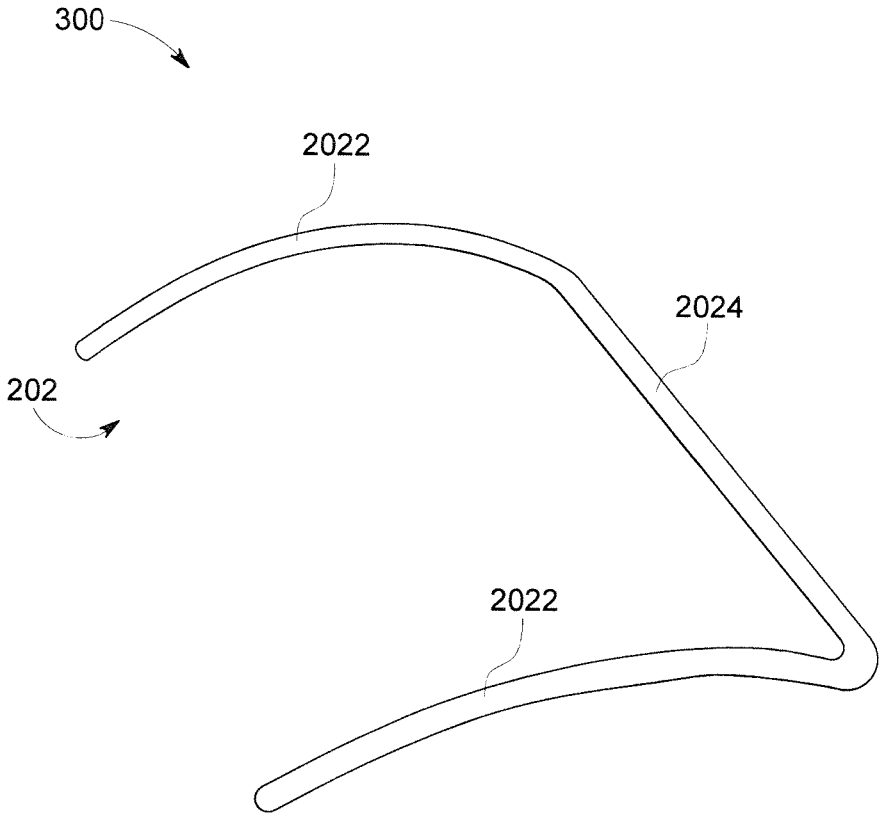
FIG. 3 illustrates a perspective view of a reinforcement structure for an attachment panel, in accordance with an embodiment of the disclosure.

According to an embodiment, one or more reinforced parts may be contained under the fabric (204) to keep the attachment panel (200) from folding backwards and/or provide a stable and secure mounting platform over the release apparatus (not illustrated here). FIG. 3 illustrates a perspective view (300) of a curved U-shaped reinforcement structure (202) for an attachment panel (200), in accordance with an embodiment of the disclosure. The reinforcement structure (202) is essentially a skeleton for the panel (200). Although the reinforcement structure (202) illustrated in FIG. 2 is U-shaped and curved, according to an embodiment, the reinforcement structure (202) does not have to be in a U-shape (see FIG. 16 for alternate examples) or curved. Furthermore, according to an embodiment, the reinforcement structure in any of the configurations and embodiments described in the present disclosure may also be a flat or curved plate and take on any shape or geometry. According to an embodiment the reinforcement structure (202) may be made of metal or be composed of some other rigid or semi-rigid material such as plastic, carbon fiber, or composite materials. As shown in FIG. 2, the reinforcement structure (202) has at least two elongated horizontal bars (2022) running parallel to each other and a vertical bar (2024) joining the at least two elongated horizontal bars (2022). In accordance with an embodiment of the disclosure, the at least two elongated horizontal bars (2022) are curved in a manner to be fit on the side of abdomen region of the human body. According to an embodiment one or more elongated horizontal bars (2022) may also run parallel to the two elongated horizontal bars (2022) that are illustrated in FIG. 3.

According to an embodiment, the reinforcement structure (202) may incorporate a plurality of geometries and angles/radius curvature and be made of one or a combination of a plurality of materials.

Figure 4:
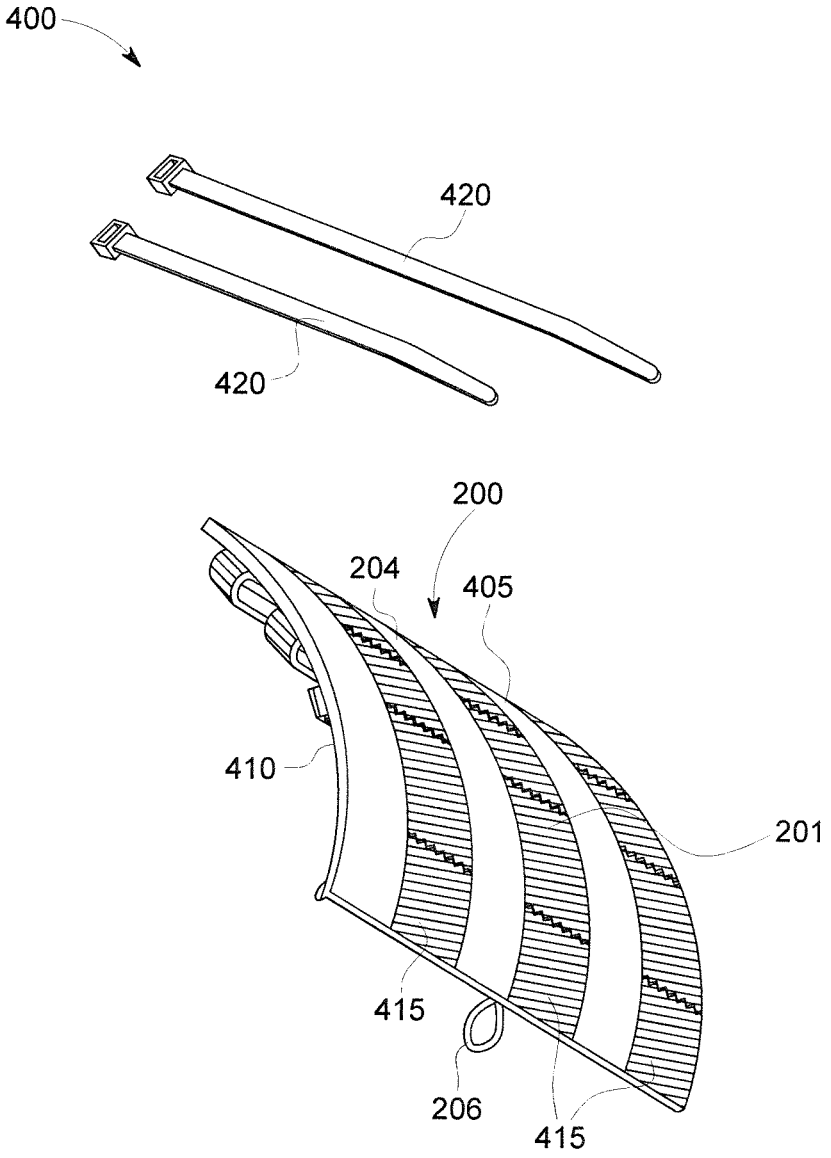
FIG. 4 illustrates a perspective view of the attachment panel and a securing mechanism, in accordance with an embodiment of the disclosure.

FIG. 4 illustrates a perspective view (400) of the attachment panel (200) and a securing mechanism for securing the attachment panel (200) to a cummerbund, in accordance with an embodiment of the disclosure. As shown in FIG. 4, the attachment panel (200) has an outer face (405) and an inner face (410). In accordance with an embodiment of the disclosure, the outer face (405) has a plurality of sewn webbing slots (201) capable of receiving one or more pouches. In accordance with an embodiment of the disclosure, the outer face (405) of the attachment panel (200) includes a plurality of strips (415) adapted to be tacked on the outer face (405) of the attachment panel (200) such that the tacking of the plurality of strips (415) creates the plurality of sewn webbing slots (201). Further, the plurality of strips (415) is tacked in a manner perpendicular to the plurality of strips (415) as illustrated in FIG. 4. In accordance with an embodiment of the disclosure, the plurality of strips (415) is of nylon material which is tacked on the fabric (204) of the attachment panel (200). Further, in accordance with an embodiment of the disclosure, the tacking may be done by stitching the plurality of strips (415) on to the fabric (204) of the outer face (405) of the attachment panel (200). Further, the stitching may be done in a manner such that the tacking of the plurality of strips (415) provides a plurality of sewn webbing slots (201) as shown in FIG. 4. According to an embodiment, hook and look strips may be stitched to either or both of the outer facing side of the fabric (204) and the inner facing side of each strip (415).

Figure 10:
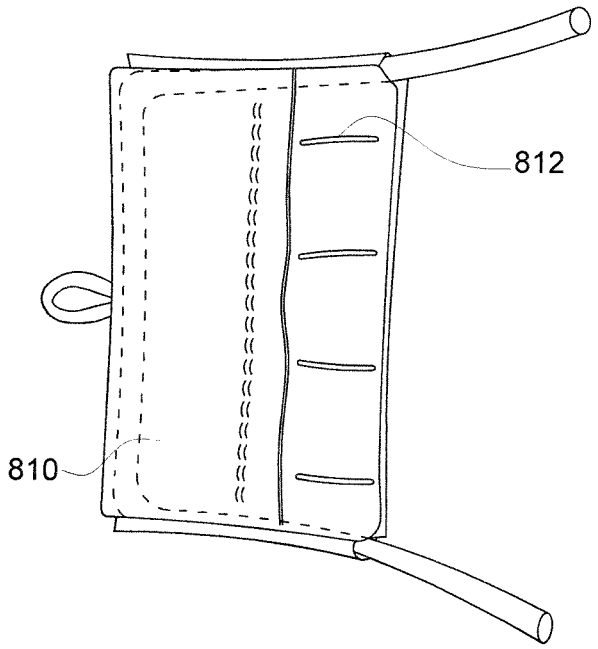
FIG. 10 illustrates the inner face of the attachment panel, in accordance with an embodiment of the disclosure.

According to an embodiment, the fabric (204) may have a grid or rows of slots (like a MOLLE grid) that are cut, similar to the slots (102) in FIG. 1 and FIG. 10 such that the plurality of strips (415) are not needed. According to an embodiment, one or more hook and loop strips may be stitched on the fabric (204).

According to an embodiment, the fabric (204) may cover a protective insert (not illustrated) made from Tegris® that can be placed inside the reinforcement structure (202) between, on top and/or below the outermost elongated horizontal bars (2022). According to an embodiment, the fabric (204) may be stitched around and/or to the protective insert such that the protective insert is securely held inside, on top and/or below the reinforcement structure (202). Tegris® is a thermoplastic composite that provides stiffness and impact resistance at a very light weight and does not crack under high or low temperatures. Other materials with similar attributes may be used instead of Tegris® for the rigid material, such as HMPE (high-modulus polyethylene) plastic, LMPE plastic, Kydex®, Boltaron®, rubber, etc). In addition, composite and/or standalone materials of Kevlar®, Dyneema® Specra® and/or similar can be used instead of Tegris® for added ballistic and fragmentation protection.

In accordance with an embodiment of the disclosure, one or more securing mechanisms are provided to fasten and/or fix the attachment panel (200) to the MOLLE attachment points (i.e. sewn webbing slots (201)) and/or the release mechanism of a cummerbund. One type of securing mechanism is self-locking zip ties (420), two of which are illustrated in FIG. 4 and will be used throughout the disclosure for exemplary purposes only. Securing mechanisms may be self-locking zip ties (to fasten permanently), reusable/releasable zip ties, polymer latching straps, rubber latching straps, webbing, fabric, cord, elastic, hook and loop tape, Velcro Onewrap®, and/or a combination of strap mechanisms such as cut fabric and/or laminate strips and/or webbing with or without triglide/slide and/or similar buckles and/or hardware or a plurality releasable and/or permanent latching mechanisms.

In accordance with an embodiment of the disclosure, the fabric (204) on the outer face (405) of the attachment panel (200) further includes a vertical cavity (610) (illustrated in FIG. 6) that is perpendicular to the slots (201) and tunnels across the outer face (405). In accordance with an embodiment of the disclosure, the vertical cavity (610) is provided between the fabric (204) and the plurality of strips (415) to allow the passage of one or more zip ties (420) through the outer face (405) of the attachment panel (200) (shown in FIG. 6).

Figure 5:
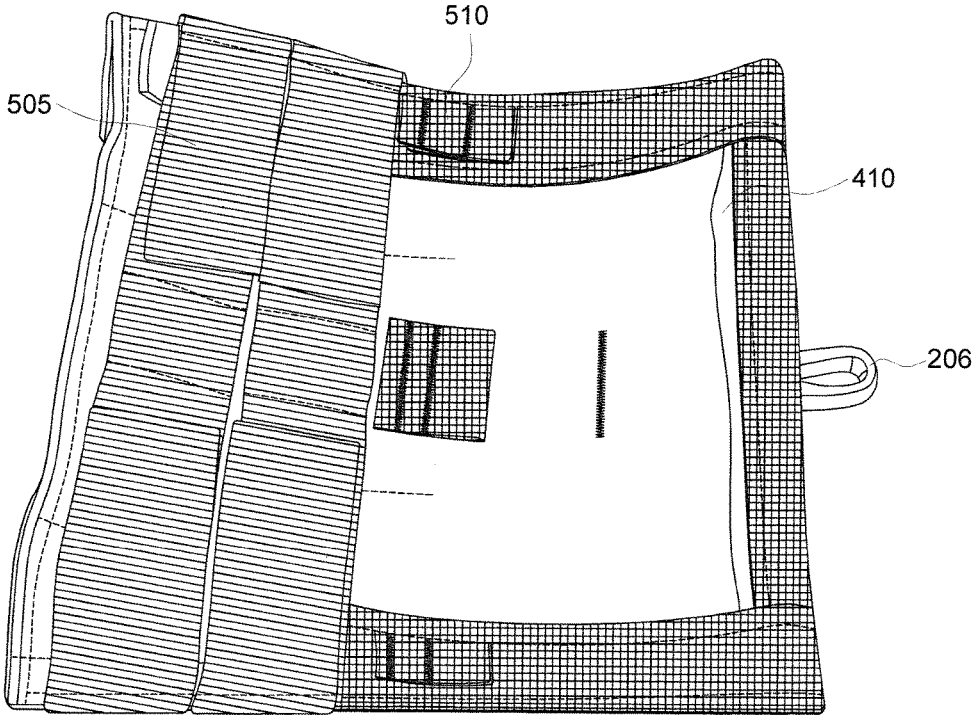
FIG. 5 illustrates an inner face of the attachment panel, in accordance with an embodiment of the disclosure.

FIG. 5 illustrates the inner face (410) of the attachment panel (200), in accordance with an embodiment (500) of the disclosure. As shown in FIG. 5, the inner face (410) of the attachment panel (200) has one or more attachment strips (505) oriented perpendicular to slots (201) and adapted to secure the attachment panel (200) with the cummerbund (104). In accordance with an embodiment of the disclosure, the one or more attachment strips (505) are hook and loop strips stitched to the inner facing fabric portion toward one lateral end of the attachment panel (200) such that they can be securely fastened to a cummerbund that has a plurality of strips (415) (e.g. webbing attachment points) or a MOLLE grid. According to an embodiment, the hook and loop strips (505) attach to a counterpart hook and loop fabric that are behind a plurality of slots (201) of the cummerbund (104). Further, the inner face (410) of the attachment panel (200) further includes one or more tunnels (510) adapted to guide a zip tie (420) through the one or more tunnels (510) such that the zip ties (420) traverse the inner face (410). FIG. 5 illustrates an embodiment in which three tunnels (510) are arranged in a straight line to guide the passage of single self-locking zip-tie (420) vertically across the inner face (410). According to an embodiment, there may be more than one set of one or more tunnels (510) to guide additional zip ties vertically across the inner face (410). According to an embodiment, at least a portion of the vertical cavity (610) on the outer face (405) is aligned with the one or more tunnels (510) on the inner face (410). According to an embodiment, the vertical cavity (610) and the one or more tunnels (510) are disposed such that at least one zip tie (420) is guided to fasten around the release apparatus (106).

According to an embodiment, the securing mechanism may include one or more zip ties (420) that secure inner face (410) of the attachment panel (200) to the release mechanism (106). Further, the attachment panel (200) is fastened to the horizontal and/or vertical slots (201) of the cummerbund (104) on the other side using one or more attachment strips (505) provided on the inner face (410) of the attachment panel (200). The attachment panel (200) is fastened on two sides or stitched with the fabric to restrict movement and/or rotation of the attachment panel (200). According to an embodiment, the attachment panel (200) is held so firmly with the cummerbund (104) that the attachment panel essentially becomes a part of the plate carrier (100).

Figure 6:
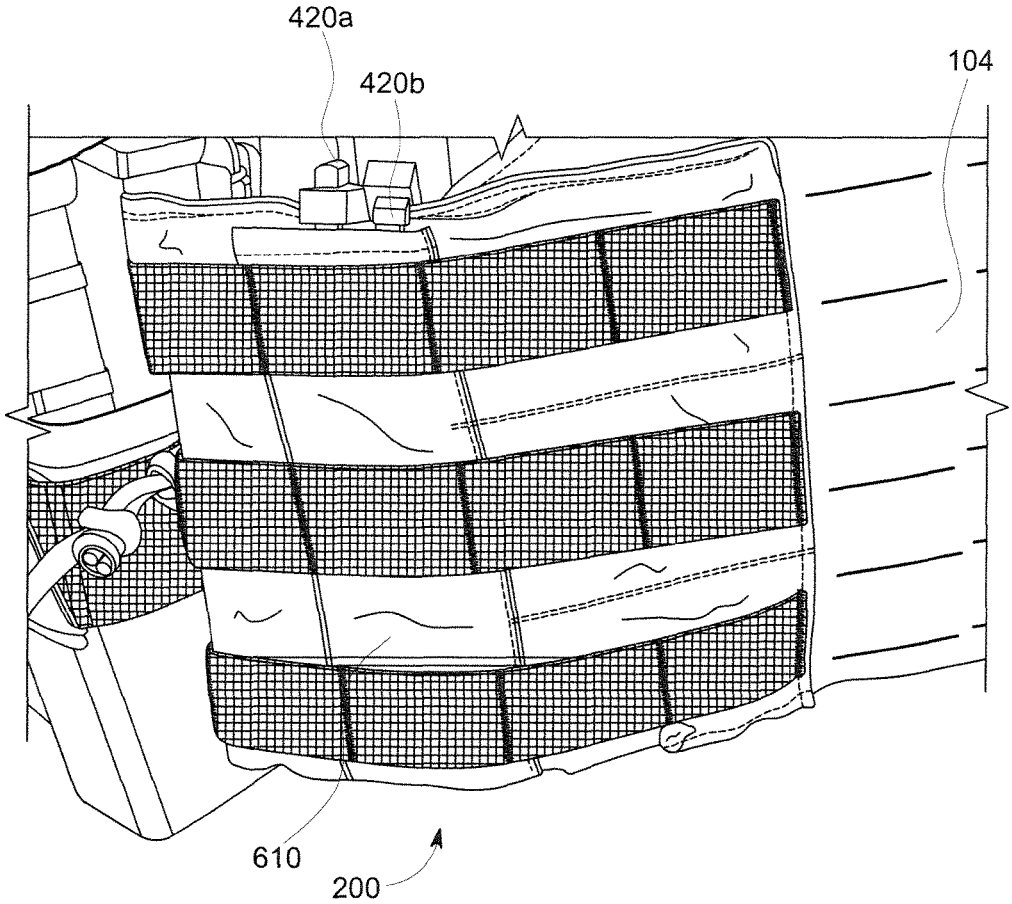
FIG. 6 illustrates the outer face of an attachment panel that is secured to a cummerbund that is fastened to an armor carrier, in accordance with an embodiment of the disclosure.

In accordance with an embodiment of the disclosure, a portion of the attachment panel (200) is held above the release mechanism (106) of the cummerbund (104) in a manner such that the attachment panel (200) overlaps the release mechanism (106) of the cummerbund (104). FIG. 6 illustrates the attachment panel (200) securely fastened on the cummerbund (104), in accordance with an embodiment of the disclosure. As shown in FIG. 6, the attachment panel (200) is held firmly using zip ties (420) on the release mechanism (106) and the connector strips (505) securely fastened to the slots (201) of the cummerbund (104), covering the release mechanism (106) (not visible) of the cummerbund (104).

Figure 7:
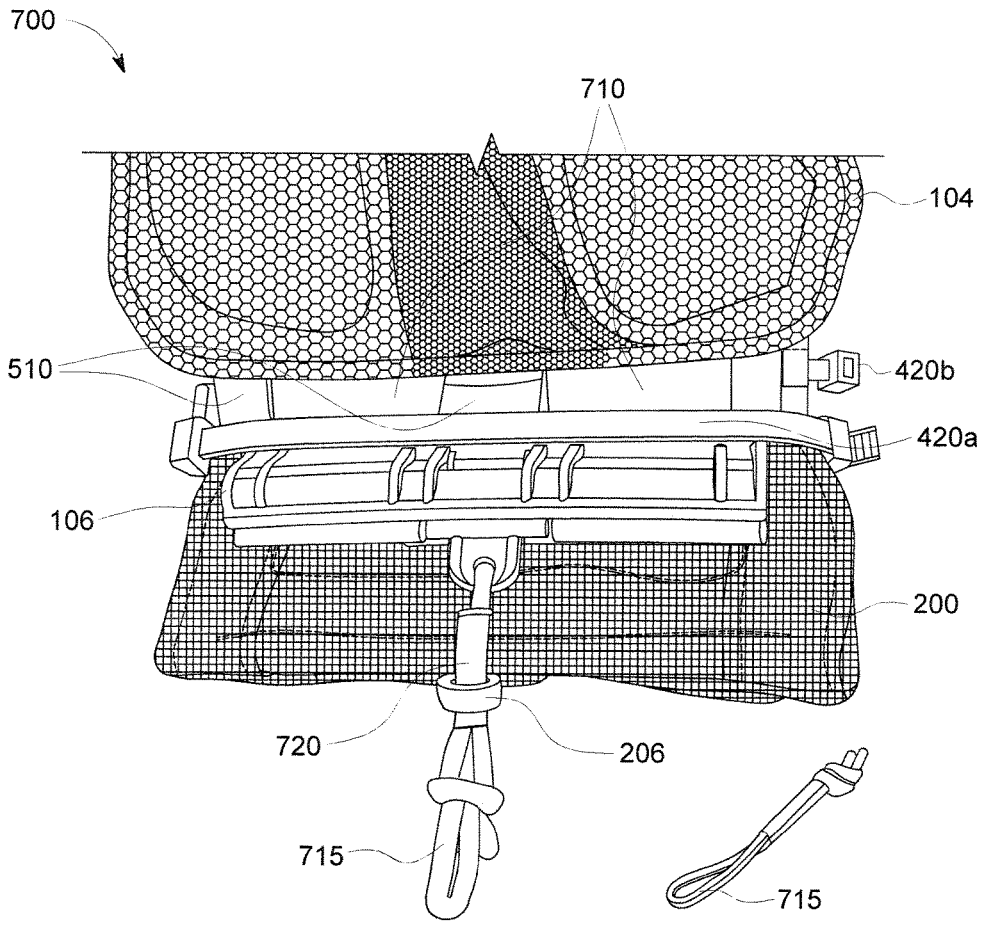
FIG. 7 illustrates a release mechanism secured to an attachment panel, in accordance with an embodiment of the disclosure.

Further, the manner of fastening the attachment panel (200) on the cummerbund (104) is described below:

The attachment panel (200) is fastened over the release mechanism (106) such that the inner face (410) of the attachment panel (200) is in contact with the release mechanism (106). Two zip ties (420) are inserted through the vertical cavity (610) provided on the outer face (405) of the attachment panel. FIG. 7 illustrates the release mechanism (106) fastened to the attachment panel (200), in accordance with embodiment (700) of the disclosure. In FIG. 7, the inner face sides of the cummerbund (104) and the attachment panel (200) are shown. As shown in FIG. 7, a first zip tie (420*b*) out of two zip ties (420) is passed through the one or more tunnels (510). In an embodiment, the first zip tie (420*b*) that is passed through the one or more tunnels (510) on the inner face (410) is also passed through one or more couple webbing (710) that couple the release mechanism (106) to the cummerbund (104), thereby securely fastening the attachment panel (200) to the release mechanism (106). According to an embodiment, the first zip tie (420*b*) may also be passed through the vertical cavity (610) on the outer face (405) of the attachment panel (200) before being secured or locked. According to an embodiment, a second zip tie (420*a*) is passed over the couple webbing (710) on the inner face (410) as shown in FIG. 7 and also passed through the vertical cavity (610) on the outer face (405) of the attachment panel (200) before being secured or locked in order to help prevent the attachment panel (200) from wiggling or folding back and forth.

According to an embodiment the release mechanism (106) may have one or more passages molded into it through which the first zip tie (420*b*) and/or the second zip tie (420*a*) can be passed to securely fasten the attachment panel (200) to the release mechanism (106). The one or more passages are similar to the molded passages (2310) shown in FIG. 23. Also, according to an embodiment, the second zip tie (420*a*)

may be passed through the same or adjacent passages molded into the release mechanism (106) and also passed through the vertical cavity (610) on the outer face of the attachment panel (200) before being secured or locked. According to another embodiment, the one or more passages may be molded on a side of the release mechanism (106) that faces the inner face (410) of the attachment panel (200). Also, according to an embodiment, the tunnels (510) may be aligned with the one or more passages.

Although not shown, the one or more attachment strips (505), provided on the inner face (410) of the attachment panel (200), are pushed in through the plurality of slots (102) (or sewn webbing slots, according to an embodiment) of the cummerbund (104). The one or more attachment strips (505) are adapted to fasten to the cummerbund (104). According to an embodiment, the inner lining of the cummerbund (104) may have loop fabric of the loop and hook mechanism (e.g., Velcro®) such that the one or more attachment strips (505) firmly fastens with the cummerbund (104).

Although not shown, instead of using one or more attachment strips (505) made from Velcro® Onewrap, strips made from webbing, laminate fabric, fabric and/or similar with snap fasteners or tucking ends back into the cummerbund slots with a sewn in piece of reinforced plastic or using hook/loop materials at each end may be used instead to attach the embodiment to a body armor carrier's cummerbund that uses a sewn webbing MOLLE grid slots (201) and/or cut MOLLE grid slots (102).

In accordance with an embodiment of the disclosure, the attachment panel further includes a loop (206) through which an unlocking cord of the release mechanism (106) may be passed through. According to an embodiment, an extension cord (715) may be adapted to join with the unlocking cord (720) of the release mechanism (106) in order to increase the length of the unlocking cord (720).

In accordance with one embodiment of the disclosure, instead of self-locking zip ties (420) other locking means may be used such as cut fabric straps (not shown) made from the fabric (204) and/or a laminate of fabrics (not illustrated). Further, the self-locking zip ties (420) as shown in FIG. 4 are just an exemplary representation for securing the attachment panel (200) to the release mechanism (106) of the cummerbund (104). Securing mechanisms may be self-locking zip ties (to fasten permanently), reusable/releasable zip ties, polymer latching straps, rubber latching straps webbing, fabric, cord, elastic, hook and loop tape, Velcro Onewrap®, and/or a combination of strap mechanisms, such as cut fabric and/or laminate strips and/or webbing with or without triglide/slide and/or similar buckles and/or hardware or a plurality releasable and/or permanent latching mechanisms and such. Moreover, the cut fabric straps may be formed from the same material of that of the plate carrier (100) fabric, or any other strong material such as nylon or a composite laminate of materials may also be used.

In accordance with one embodiment of the disclosure, the cut fabric may be provided with a triglide/slide buckle arrangement (not shown) and/or similar for tightening and loosening the cut fabric strap when in use.

Figure 8:
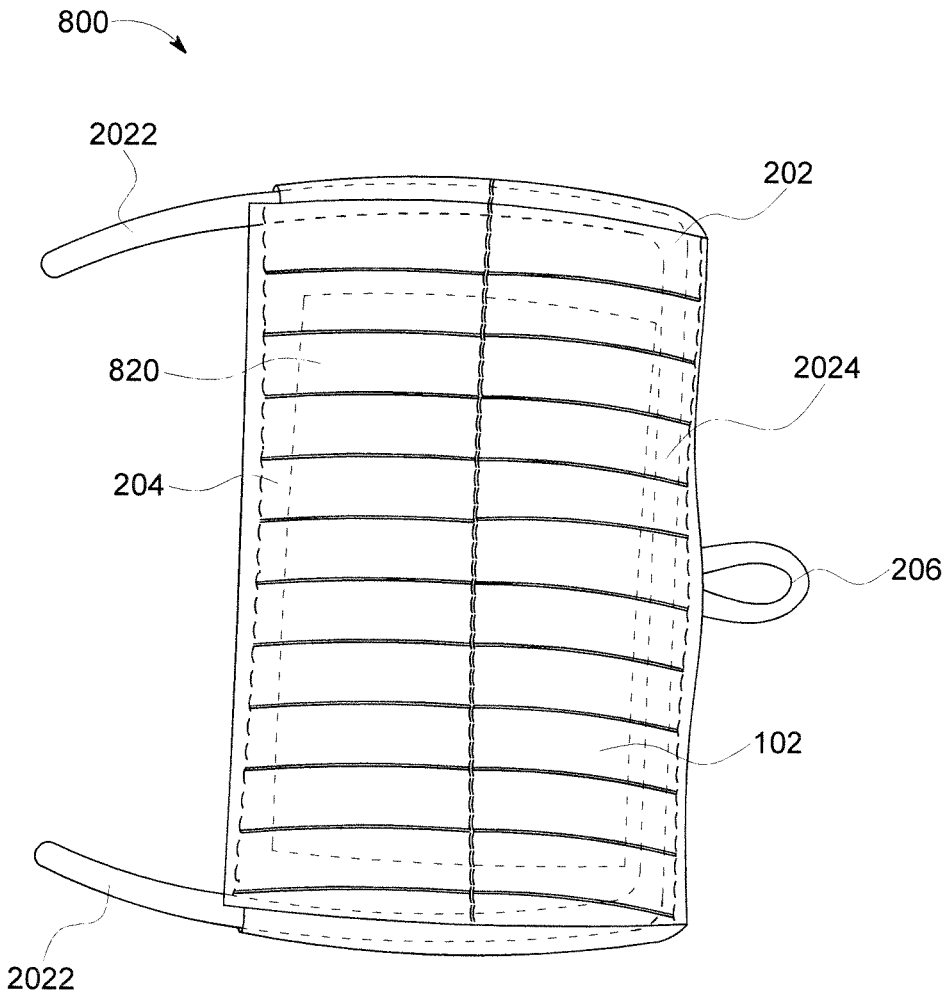
FIG. 8 illustrates a skeletonized attachment panel, in accordance with another embodiment of the present disclosure.
Figure 9:
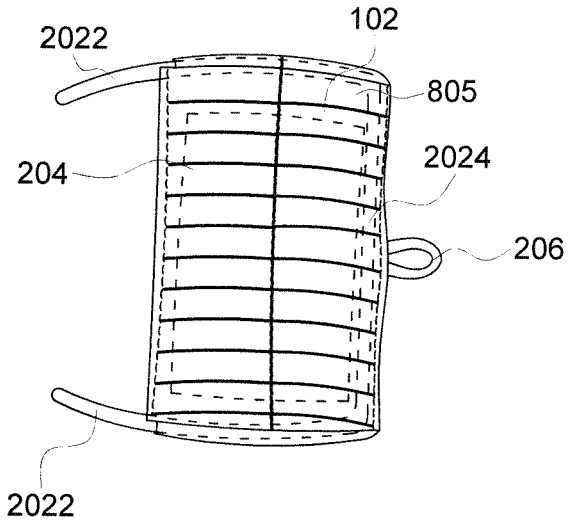
FIG. 9 illustrates the outer face of a skeletonized attachment panel, in accordance with an embodiment of the disclosure.

FIG. 8 illustrates an attachment panel (800), in accordance with another embodiment of the present disclosure. As shown in FIG. 9, the attachment panel (800) comprises a reinforcement structure (202) and a fabric (204) wound over the reinforcement structure (202) having a plurality of slots (102) (e.g. MOLLE grid or MOLLE attachment points) capable of receiving one or more pouches or other equipment. The reinforcement structure (202) has at least two elongated horizontal bars (2022) running parallel to each other and a vertical bar (2024) joining the at least two elongated horizontal bars (2022). As already discussed with reference to FIG. 2, the reinforcement structure (202) may take on any shape (see FIG. 16 for alternate examples) and/or curvature. Furthermore, the reinforcement structure (202) may be made of metal or be composed of some other rigid or semi-rigid material such as plastic, carbon fiber, or composite materials. In accordance with an embodiment of the disclosure, the fabric (204) is wound over a portion of the reinforcement structure (202) such that the elongated horizontal bars are uncovered as shown in FIG. 8. In accordance with an embodiment of the disclosure, the least two elongated horizontal bars (2022) have a curvature in a manner to fit the attachment panel (800) on the side of abdomen region of the human body.

According to an embodiment, a protective insert (820) composed of a rigid or semi-rigid material may be inserted under the fabric (204) of the attachment panel (800). The protective insert (820) is illustrated as being significantly less than the entire surface area of the attachment panel (800); however, according to an embodiment, the protective insert (820) may be sized to substantially cover the entire surface area of the attachment panel (800). According to an embodiment, the fabric (204) may be stitched around and/or to the protective insert (820) such that the protective insert (820) is securely held inside the reinforcement structure (202) and/or can be securely held on top, between, and/or below the reinforcement structure (202).

According to an embodiment, the protective insert (820) provides stiffness and impact resistance at a very light weight. Such protective insert (820) may be made of thermoplastic composite material such as Tegris®. Tegris® is a thermoplastic composite that provides stiffness and impact resistance at a very light weight and does not crack under high or low temperatures. Other materials with similar attributes may be used instead of Tegris® for the rigid material, such as HMPE (high-modulus polyethylene) Plastic, LMPE plastic, Kydex®, Boltaron®, rubber, etc). In addition, composite and/or standalone materials of Kevlar®, Dyneema®, Specra® and/or similar can be used instead of Tegris for added ballistic and fragmentation protection. According to an embodiment, the piece of thermoplastic composite material may be pliable or have a similar curvature as provided to the reinforcement structure (202) of the attachment panel (200). According to an embodiment, curvature to the piece of thermoplastic composite material and/or a plurality of other ballistic/fragmentation protective and non-ballistic/fragmentation protective materials that may be used may be provided by heating the piece of material using suitable heating and molding means. In accordance with an embodiment of the disclosure, the suitable heating means heated molding tools and/or similar method that can form the material to a plurality of shapes and curvatures.

Although not illustrated, according to an embodiment, any panel system or configuration described in the present disclosure may include a protective insert under the fabric of the panel, whether attached or built-in that can be permanently built in or removable.

In accordance with an embodiment of the disclosure, the attachment panel (800) further comprises a loop (206) adapted to receive an unlocking cord (720) and/or an extension cord (715) of the release mechanism (106) in a manner to facilitate axial pull of the unlocking cord (720) of the release mechanism (106). Similar to the loop (206) of the attachment panel (200), the loop (206) is fixed into the fabric (204) of the attachment panel such that a portion of the loop (206) is inside the attachment panel (800) and other portion is outside the attachment panel (800).

FIG. 9 illustrates the outer face (805) of the attachment panel (800), in accordance with an embodiment of the disclosure. The outer face has a plurality of slots (102) (e.g. MOLLE grid or MOLLE attachment points). In accordance with an embodiment of the disclosure, the plurality of slots (102) may be cut slots and/or be vertical and/or of a plurality of angles. Though not illustrated, the slots (102) may be provided by stitching a plurality of strips similar to the strips (415) of FIG. 4.

Though not illustrated, according to an embodiment the slots can be vertical and/or a plurality of angles (102) may be provided by stitching a plurality of strips similar to the strips (415) of FIG. 4. According to an embodiment, the vertical gap interval between slots (102) of the attachment panel (800) may be short in order to promote alignment with slots (102) provided by various manufacturers of the cummerbund (104). For example, the vertical gap interval between slots (102) may be a half inch.

In accordance with an embodiment of the disclosure, the fabric (204) on the outer face (805) of the attachment panel (800) further includes at least one vertical cavity similar to the vertical cavity (610) of the attachment panel (200) that runs perpendicular to the slots (102) that tunnels underneath and across the vertical length of fabric (204). In accordance with an embodiment of the disclosure, the vertical cavity is provided such that the cavity allows the passage of zip ties (420) under the outer face (405) of the attachment panel (800). An example is illustrated in FIG. 11.

FIG. 10 illustrates an inner face (810) of the attachment panel (800), in accordance with an embodiment of the disclosure. According to an embodiment, the inner face (810) is also provided with one or more slots (102) that allow passage of zip ties (420) or similar to snake through the inner face (810) of the attachment panel (800) and couple webbing of cummerbund (104) and/or passages molded into the release mechanism (106) similar to the molded passages (2310) shown in FIG. 23. According to an embodiment, the inner face (810) may have one or more tunnels similar to tunnels (510) of FIG. 5 to allow passage of zip ties (420) or similar securing mechanisms already described.

In accordance with an embodiment of the disclosure, the attachment panel (800) further includes a securing mechanism for fixing the attachment panel (800) on the armor carrier (100). The securing mechanism may include a plurality of zip ties (420) that secures the attachment panel (800) to the release mechanism (106). In accordance with an embodiment of the disclosure, instead of zip ties (420), polymer latching straps, rubber latching straps webbing, fabric, cord, elastic, hook and loop tape, Velcro Onewrap®, and/or a combination of strap mechanisms, such as cut fabric and/or laminate strips and/or webbing with or without triglide/slide and/or similar buckles and/or hardware or a plurality releasable and/or permanent latching mechanisms and such may also be used.

Figure 11:
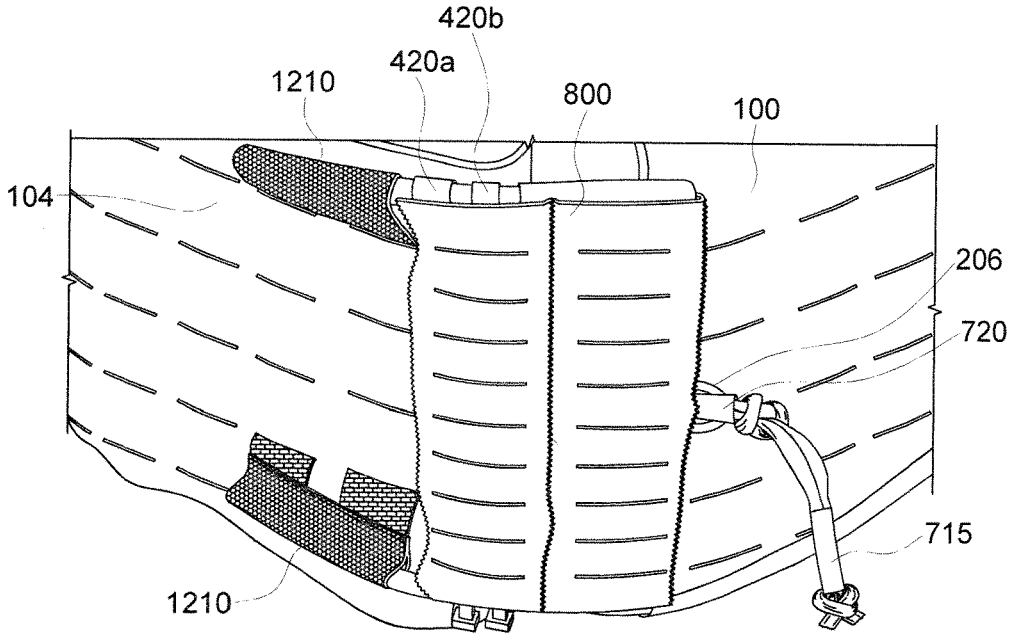
FIG. 11 illustrates an attachment panel secured to a cummerbund, in accordance with an embodiment of the disclosure.
Figure 12:
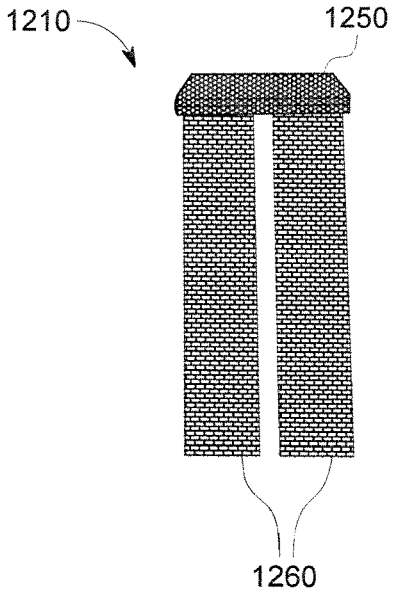
FIG. 12 illustrates a tunnel-ended strip, in accordance with an embodiment of the disclosure.

FIG. 11 illustrates an attachment panel (800) secured to a cummerbund (104), in accordance with an embodiment of the disclosure. According to an embodiment, at least one tunnel-ended strip (1210) may be provided for fastening the free ends of the elongated horizontal bars (2022) to the cummerbund (104) via slots (102) of the cummerbund (104). FIG. 12 illustrates a tunnel-ended strip (1210) according to an embodiment of the present disclosure. Each tunnel-ended strip (1210) comprises a tunnel portion (1250) that wraps around a free end of an elongated horizontal bar (2022) and at least one strip (1260) that fastens to the cummerbund (104). The embodiment illustrated in FIG. 11 has one tunnel portion (1250) and two strips (1260); however, in alternate embodiments, tunnel-ended strips may have a shorter or longer tunnel portion and/or one strip or more than two strips. For example, each of the tunnel-ended strips (1910) of FIG. 19 has a shorter tunnel portion and a single strip. The tunnel portion (1250) may be stitched to slide on or be created during fastening by wrapping at least one strip around the elongated horizontal bar (2022). At least one strip (1260) may have hook and/or loop fabric on each side to fasten to the counterpart fabric on the inner side of the fabric of the cummerbund (104) and/or be made from webbing, laminate fabric, fabric and/or similar with snap fasteners or tucking ends back into the cummerbund (104) via slots (102) with a sewn in piece of reinforced plastic or using hook/loop materials at each end may be used to attach to cut slots (102) and/or sewn webbing MOLLE slots (102). According to an embodiment, the at least one strip (1260) may be a Velcro® Onewrap® (or similar) strip to secure the elongated horizontal bars (2022) of the attachment panel (800) with the cummerbund's MOLLE grid and to keep the elongated horizontal bars (2022) from rolling over the cummerbund (104) and digging into the wearer's torso/skin/side of the body. According to another embodiment, the elongated horizontal bars (2022) may be secured to the cummerbund (104) by straps and/or a sewn tunnel sewn to straps (more secure then using single nylon strips). This would help prevent the elongated horizontal bars (2022) from sliding off the cummerbund (104) and rubbing against the wearer in an uncomfortable manner. As such, the attachment panel (800) would be secured by both tunnel-ended strips (1210) and the zip ties (420) to restrict movement and/or rotation of the attachment panel (800). The goal is to have the attachment panel (800) be held so firmly with the cummerbund (104) that the attachment panel (800) becomes a part of the cummerbund (104). The tunnel-ended strips (1210) may vary in geometry and construction and can be used to secure different geometries and curvatures of a reinforcement structure (202) of the attachment panel (800) firmly to a cummerbund (104) and garment.

In accordance with an embodiment of the disclosure, attachment panel (800) is held above the release mechanism (106) of the cummerbund (104) in a manner that the attachment panel (800) overlaps the release mechanism (106) of the cummerbund (104). FIG. 12 illustrates the attachment panel (800) fastened on to the cummerbund (104) which is attached/connected to the armor carrier (100), in accordance with an embodiment of the disclosure. As shown in FIG. 11, the attachment panel (800) is held nearly flush with the cummerbund (104) and armor carrier (100), with the extension cord 720 extending from the unlocking cord (720) which extends from the release mechanism (106) of the cummerbund (104) out through the loop (206).

According to an embodiment, the slots (102) on the attachment panel (800) may be horizontally aligned with the slots of the cummerbund, chest rig or some other garment to which the attachment panel is fastened. Furthermore, although in FIG. 11 the horizontal spacing of slots (102) are not uniform all the way across from the cummerbund (104) to the attachment panel (800) in FIG. 20, this is merely one embodiment for illustrative purposes. According to an embodiment, the slots (102) may be evenly spaced across the cummerbund (104) (or chest rig or some other garment) and attachment panel (800) such that the transition from the cummerbund (104) (or chest rig or some other garment) to the attachment panel (800) mimics a continuous MOLLE grid.

Figure 13:
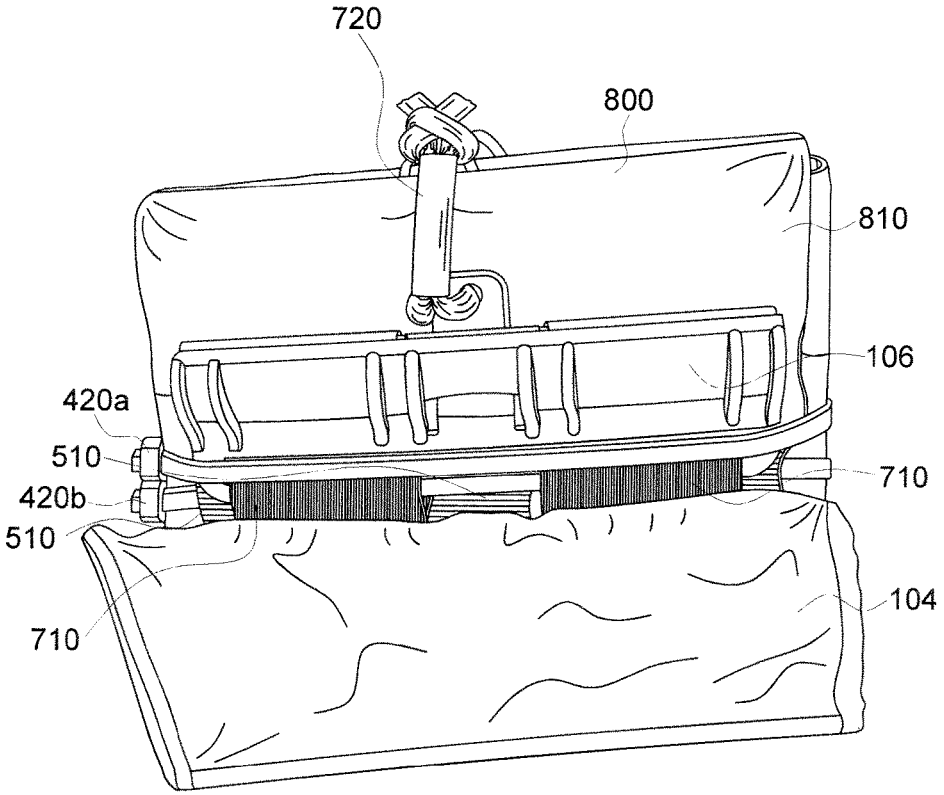
FIG. 13 illustrates the release mechanism secured to a skeletonized attachment panel, in accordance with an embodiment of the disclosure.
Figure 14:
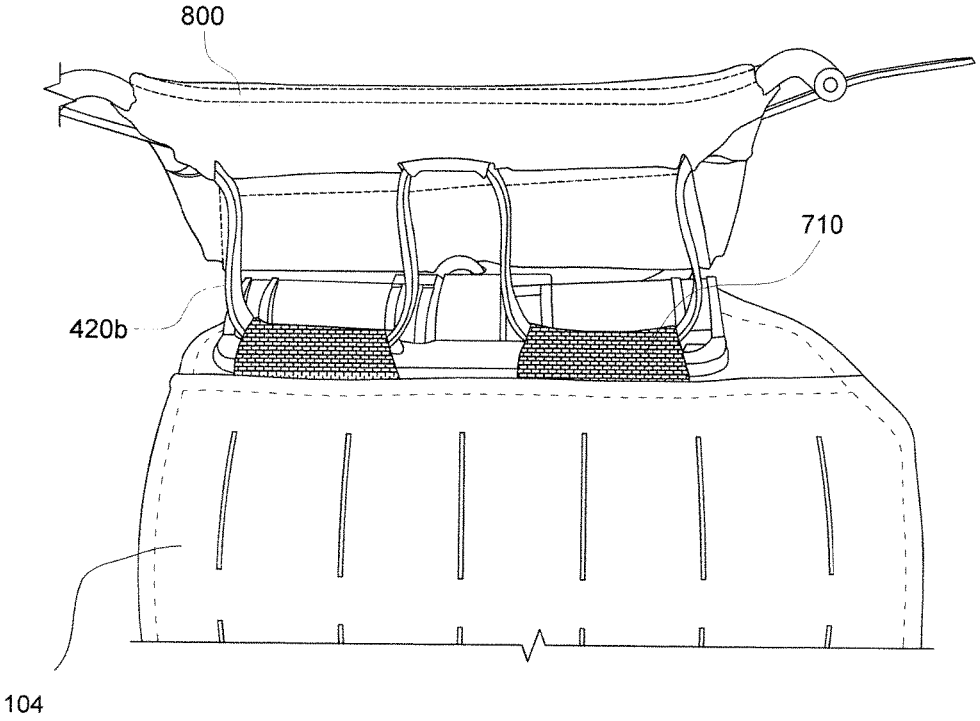
FIG. 14 illustrates a zip tie passing in a snakelike manner through slots provided on the inner face of an attachment panel and through one or more buckle webbings, in accordance with an embodiment of the disclosure.

Further, the manner of fixing the attachment panel (800) on the cummerbund (104) is described below:

The attachment panel (800) is kept on the release mechanism (106) such that the inner face (810) of the attachment panel (800) is in contact with the release mechanism (106). Two zip ties (420*a* and 420*b*) are inserted through the cavity provided on the outer face (805) of the attachment panel (800) (illustrated in FIG. 11). FIG. 13 illustrates the release mechanism (106) fastened to the attachment panel (800) abutting the inner face (810), in accordance with an embodiment of the disclosure. As shown in FIG. 14, a first zip tie (420*b*) out of two zip ties (420) is passed in a snakelike manner through the one or more slots (102) provided on the inner face (810) of the attachment panel (800) and through one or more couple webbing (710) that couple the release mechanism (106) to the cummerbund (104), thereby securely fastening the attachment panel (800) to the release mechanism (106). According to an embodiment, the first zip tie (420*b*) may also be passed through the vertical cavity (similar to vertical cavity (610) of attachment panel (200)) on the outer face (805) of the attachment panel (800) before being tied. According to an embodiment, a second zip tie (420*a*) is passed over the couple webbing (710) as shown in FIG. 13 and also passed through the vertical cavity on the outer face (805) of the attachment panel (800) before being fastened in order to help prevent the attachment panel (200) from wiggling, flipping, or folding back and forth. According to an embodiment, one or both zip ties (420*a*) and (420*b*) may be passed through one or more slots (102) on the outer face of the attachment panel (800) if there is no vertical cavity that runs underneath.

According to an embodiment the release mechanism (106) may have one or more passages molded into it through which the first zip tie (420*b*) and/or the second zip tie (420*a*) can be passed to securely fasten the attachment panel (800) to the release mechanism (106). The one or more passages are similar to the molded passages (2310) shown in FIG. 23. Also, according to an embodiment, the second zip tie (420*a*) may be passed through the same or adjacent passages molded into the release mechanism (106) and also passed through a vertical cavity (similar to vertical cavity (610) of attachment panel (200)) on the outer face of the attachment panel (800) before being secured or locked.

As illustrated in FIG. 14, according to an embodiment, the inner face (810) of the attachment panel (800) is provided with one or more slots (812) that allow passage of the first zip tie (420*b*) to snake through the inner face (810) of the attachment panel (800) and couple webbing (710) which function as knuckles of a hinge that rotatably connect the attachment panel (900) to the cummerbund (104), with the zip tie (420*b*) acting as the pin to the hinge. According to an embodiment, the inner face (810) may have one or more tunnels similar to slots (812) of FIG. 10 or tunnels (510) of FIG. 5 to allow passage of zip ties (420).

According to another embodiment, the one or more passages may be molded into the side of the release mechanism (106) that faces the inner face (410) of the attachment panel (800). Also, according to an embodiment, the one or more slots (812) may be aligned with the one or more passages such that the first zip tie (420*b*) can snake through the inner face (810) of the attachment panel (800) and the molded passages that are facing the inner face (805) of the attachment panel (800). Alternatively, if the molded passages are facing away from the inner face (805) (similar to molded passages (2310) of FIG. 23), the first zip tie (420*b*) and/or the second zip tie (420*a*) may pass through the one or more slots (812) on the inner face (805) of the attachment panel (800) and wrap around release mechanism (106) and through the molded passages facing away from the inner face (805) before being securely fastened.

As illustrated in FIG. 11, at least one tunnel-ended strip (1210) may be provided for fastening the free ends of the elongated horizontal bars (2022) to the cummerbund (104) via slots (102) of the cummerbund (104). Each tunnel-ended strip (1210) comprises a tunnel portion that wraps around a free end of an elongated horizontal bar (2022) and a strip portion that fastens to the cummerbund (104). The tunnel portion may be stitched to slide on or be created during fastening by wrapping the tunnel-ended strip (1210) around the elongated horizontal bar (2022). The strip portion may have hook and/or loop fabric on each side to fasten to the counterpart fabric on the inner side of the fabric of the cummerbund (104). According to an embodiment, the strip portion may be a Velcro® Onewrap® (or similar) strip to secure the elongated horizontal bars (2022) of the attachment panel (800) with the cummerbund's cut or sewn webbing MOLLE grid.

Though not illustrated, according to an embodiment, the strip portion to secure the elongated horizontal bars (2022) of the attachment panel (800) with the cummerbund's (104) cut slots (102) or sewn webbing MOLLE grid slots (102) may be a laminate fabric, fabric and/or similar with snap fasteners or tucking ends back into the cummerbund (104) via slots (102) with a sewn in piece of reinforced plastic or using hook/loop materials at each end may be used to attach to cut slots (102) and/or sewn webbing MOLLE slots (102).

In accordance with an embodiment of the disclosure, the attachment panel (800) an extension cord (715) may be joined with the unlocking cord (720) of the release mechanism (106) in order to increase the length of the unlocking cord (720) of the release mechanism (106).

According to an embodiment, the vertical gap interval between slots (102) of the attachment panel (800) may be shorter in order to promote alignment with slots (102) provided by various manufacturers of the cummerbund (104). As shown in FIG. 11, the vertical gap interval between slots in the attachment panel (800) is half the vertical gap interval between the slots on the cummerbund (104) and the armor carrier (100).

Figure 15A:
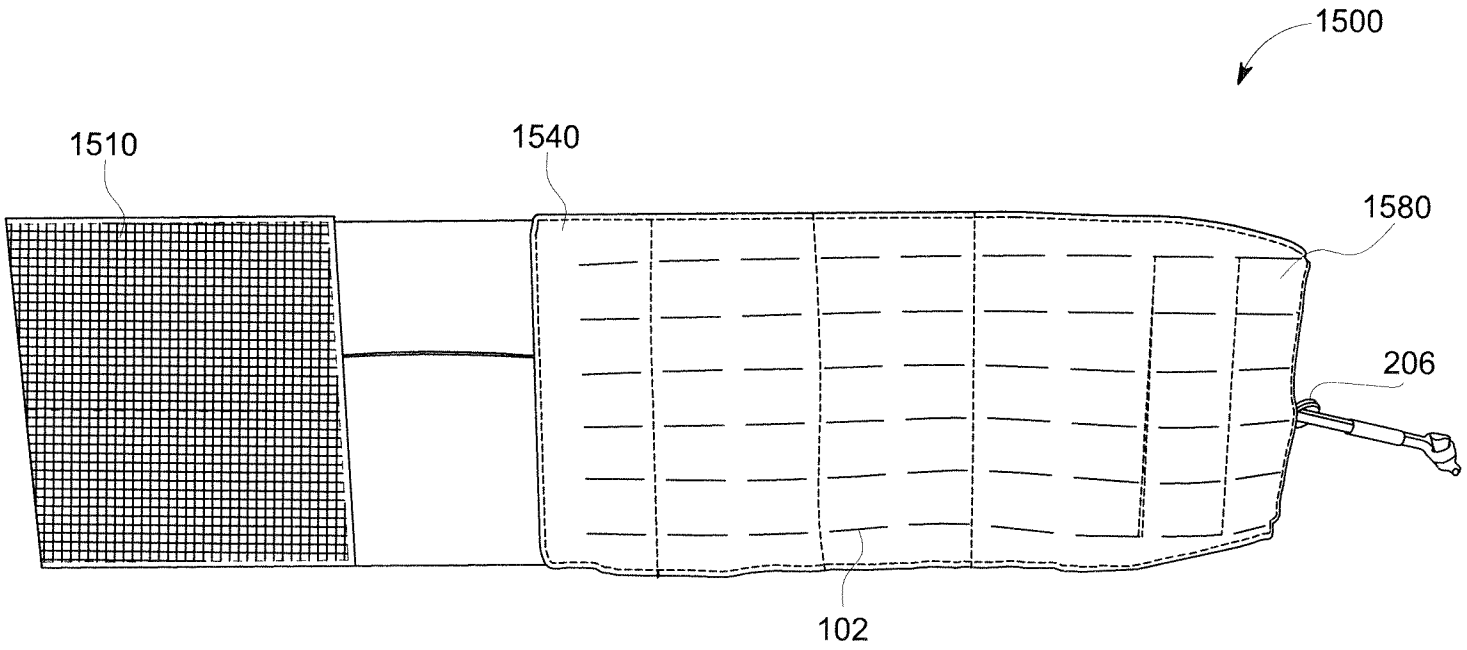
FIG. 15 illustrates an integrated cummerbund that includes a built-in panel, in accordance with an embodiment of the disclosure.
Figure 15B:
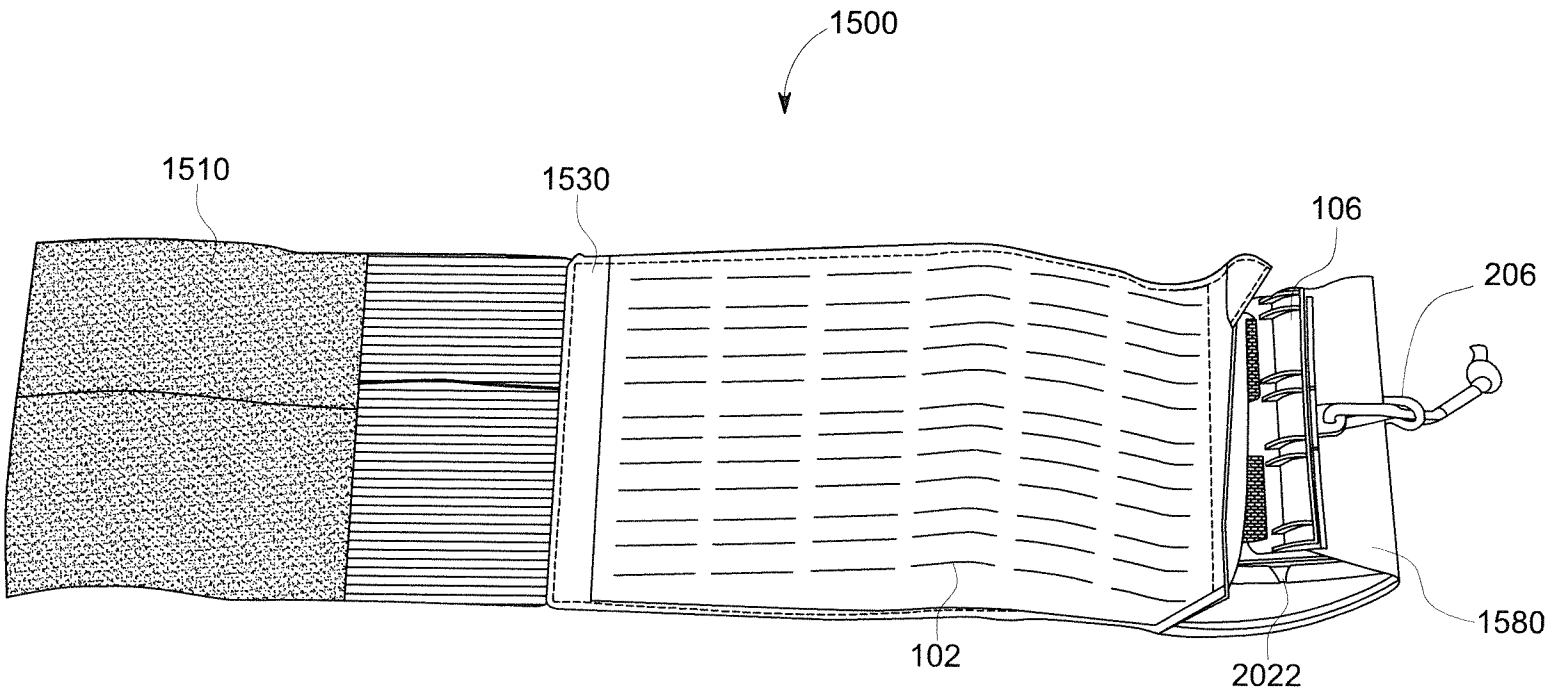

FIGS. 15*a* and 15*b* illustrate the outer face of an integrated cummerbund (1500) that includes a built-in panel that covers the release mechanism (106), in accordance with an embodiment of the disclosure. FIG. 15*a* illustrates the outer side (i.e. face side) (1540) while FIG. 15*b* illustrates the inner side (i.e. body side) (1530). It is noted that in the embodiment illustrated in FIGS. 15*a* and 15*b*, the cummerbund (1500) is an elongated structure that covers one side of a torso. That is, another cummerbund is needed to cover the opposite side of the torso.

As shown in FIGS. 15*a* and 15*b*, the integrated cummerbund (1500) has a first end area (1510) and a second end area (1520). The first end area (1510) may have a hook and loop fabric and/or other securing mechanism (or any other known means) to attach/fasten the first end area (1510) of the integrated cummerbund to a back portion of a body vest garment. As shown in FIG. 15*a*, the second end (1520) includes a built-in panel (1580) that appears seamless from the rest of the integrated cummerbund (1500). According to an embodiment, the built-in panel (1580) may be incorporated into or otherwise permanently attached during manufacture of the integrated cummerbund (1500). According to an embodiment, the built-in panel (1580) is sewn in during manufacture of the integrated cummerbund (1500) such that the elongated horizontal bars (2022) of a reinforcement structure (202) (not shown) are held in place underneath the fabric on the outer side. This is in contrast to FIG. 11, in which the elongated horizontal bars (2022) are exposed over the outer side of the cummerbund (104). Although not shown, each elongated horizontal bar (2022) may be further secured in place using any conventional technique or those previously disclosed. According to an alterative embodiment, the built-in panel (1580) may or may not have elongated horizontal bars (2022) or a reinforcement structure (202). The reinforcement structure (202) may be a plurality of geometries and curvatures and made from a plurality of materials. A protective insert (820) composed of a rigid or semi-rigid material may also be included in the embodiment made from materials those previously disclosed. The protective insert (820) may be removable.

As shown in FIG. 15B, the release mechanism (106) is covered by the built-in panel (1580) at the second end area (1520) of the integrated cummerbund (1500). Similar to FIGS. 7 and 13, the release mechanism (106) is coupled to the integrated cummerbund by the couple webbing (710). According to an embodiment, the release mechanism (106) may be securely fastened to the built-in panel (1580) using zip ties 420*a* and 420*b* as previously disclosed. Alternatively, the release mechanism (106) may be securely fastened to the built-in panel using one zip tie 420*a* (or other securing mechanism) to keep the built-in panel (1580) from folding back during use. According to an embodiment, the couple webbing (710) may be sewn to the inner face of the built-in panel (1580). Also, according to an embodiment, one or more passages (2310) may be molded into the release mechanism (106) as discussed with regard to panel (200) and panel (800) to allow one or more zip ties (420) (i.e. securing mechanism) to pass through.

The present disclosure provides a number of advantages. First, the release mechanism (106) is being covered and protected by the fastening or fixing of attachment panel (200) on the cummerbund (104) or incorporating its features to a new integrated cummerbund. The attachment panel (200) may be used on different types of release mechanisms as discussed earlier. Further, the fixation or fastening of attachment panel (200) to the release mechanism (106) allows mounting of and/or sewing on additional pouches that would otherwise not be possible.

Figure 16:
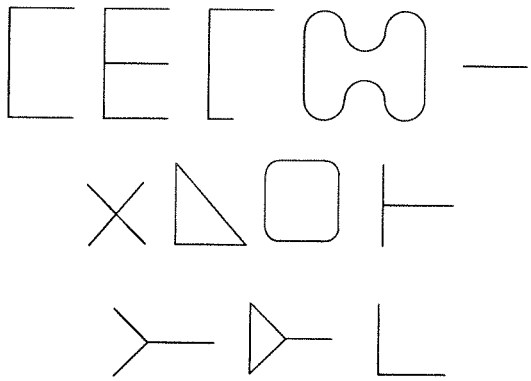
FIG. 16 illustrates a frontal view of various shapes of the reinforcement structure, in accordance with an embodiment of the disclosure.
Figure 17:
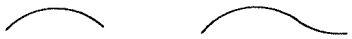
FIG. 17 illustrates a side view of various curve shapes of the reinforcement structure, in accordance with an embodiment of the disclosure.

Moreover, the reinforcement structure (202) provides required stiffness for holding the attachment panel (200). Further, the material of the reinforcement structure (202) may be one of, but not limited to, metal, plastic, fiber glass, composite, ballistic protective materials and fragmentation protective materials, and combination thereof. Also, shape of the reinforcement structure (202) shown in accompanied drawings is just an exemplary illustration. Further, the reinforcement structure (202) may include varied shaped such as, but not limited to, shape of the characters X, C, E and L with a plurality of curvatures and/or flat. FIG. 16 illustrates different frontal views of the reinforcement structure (202), in accordance with an embodiment of the disclosure. Also, FIG. 16 illustrates different cross-sectional views of the reinforcement structure (202), in accordance with an embodiment of the disclosure. A skilled person in the art would recognize that the reinforcement structure (202) may have other shapes as mentioned above and/or illustrated in FIG. 16 and FIG. 17.

Figure 18:
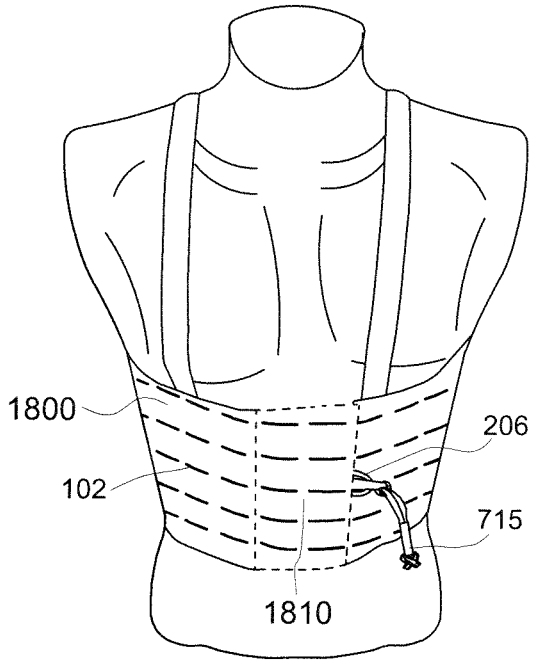
FIG. 18 illustrates a chest rig that incorporates a panel to cover its release mechanism, in accordance with an embodiment of the present disclosure.

FIG. 18 illustrates a chest rig that incorporates a panel to cover its release mechanism according to an embodiment of the present disclosure. According to an embodiment, a panel (1810), similar to attachment panel (200) or attachment panel (800) may be incorporated (or otherwise incorporated) into a chest rig that utilizes a release mechanism that creates a gap lacking MOLLE attachment points. According to an embodiment, the panel (1810) may or may not have a reinforcement structure (202). According to an embodiment, the panel (1810) is fastened to a chest rig (1800) in a same or similar manner as those embodiments described with respect to attachment panel (200), (800) and (2000). Alternatively, the panel (1810) may be built in to the chest rig (1800) in a same or similar manner as those embodiments described with respect to built-in panel (1580). Here, although not illustrated, the chest rig has the release mechanism and its counterpart—i.e. one male portion and one female portion (e.g. release mechanism (106) covered by the panel (1810) in the illustrated embodiment)—such that when the extension cord (715) is pulled, the release mechanism (106) (i.e. female portion of the release system) disengages from the male portion, thereby opening the chest rig for doffing.

Figure 19:
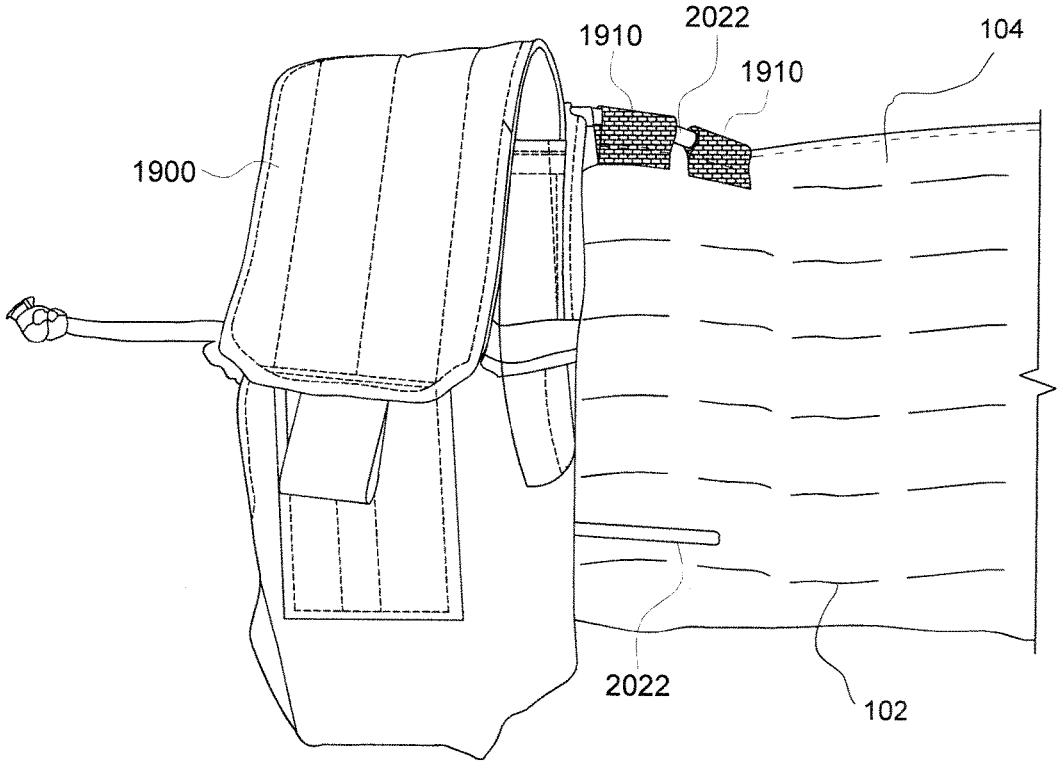
FIG. 19 illustrates an attachment pouch, in accordance with an embodiment of the present disclosure.

FIG. 19 illustrates an attachment pouch, in accordance with an embodiment of the present disclosure. According to an embodiment, the attachment pouch (1900) may be fastened to a cummerbund (104) or chest rig (1800) in a same or similar manner as those embodiments described with respect to attachment panel (200), (800) and (2000). Alternatively, the attachment pouch (1900) may be built in to a cummerbund (104) or chest rig (1800) in a same or similar manner as those embodiments described with respect to built-in panel (1580). According to the embodiment disclosed in FIG. 19, two tunnel-ended strips (1910) wrap around the top bar of the elongated bars (2022) to help hold the attachment pouch (1900) in place by fastening to a cummerbund, chest rig some or other garment through a cut slot 102 or sewn webbing slot 201 and the like as already described with regard to FIG. 11. According to an alternate embodiment, one or more different tunnel-ended strips (such as tunnel-ended strip (1210)) may be used instead. Also, the bottom bar of the elongated bars (2022) remains bare; however, in an alternate embodiment, one or more tunnel-ended strips may be used to wrap around the bottom bar. Also, according to an embodiment, both elongated bars (2022) may be held in place by a tunnel-ended strip, or the top bar may be bare while the bottom bar is help in place by a tunnel-ended strip. The embodiment may use a reinforcement structure (202) that does not include elongated bars (2022) and can be a plurality of geometries and curvatures. The embodiment may also include a protective insert (820) that is permanently built in or is removable.

Figure 20:
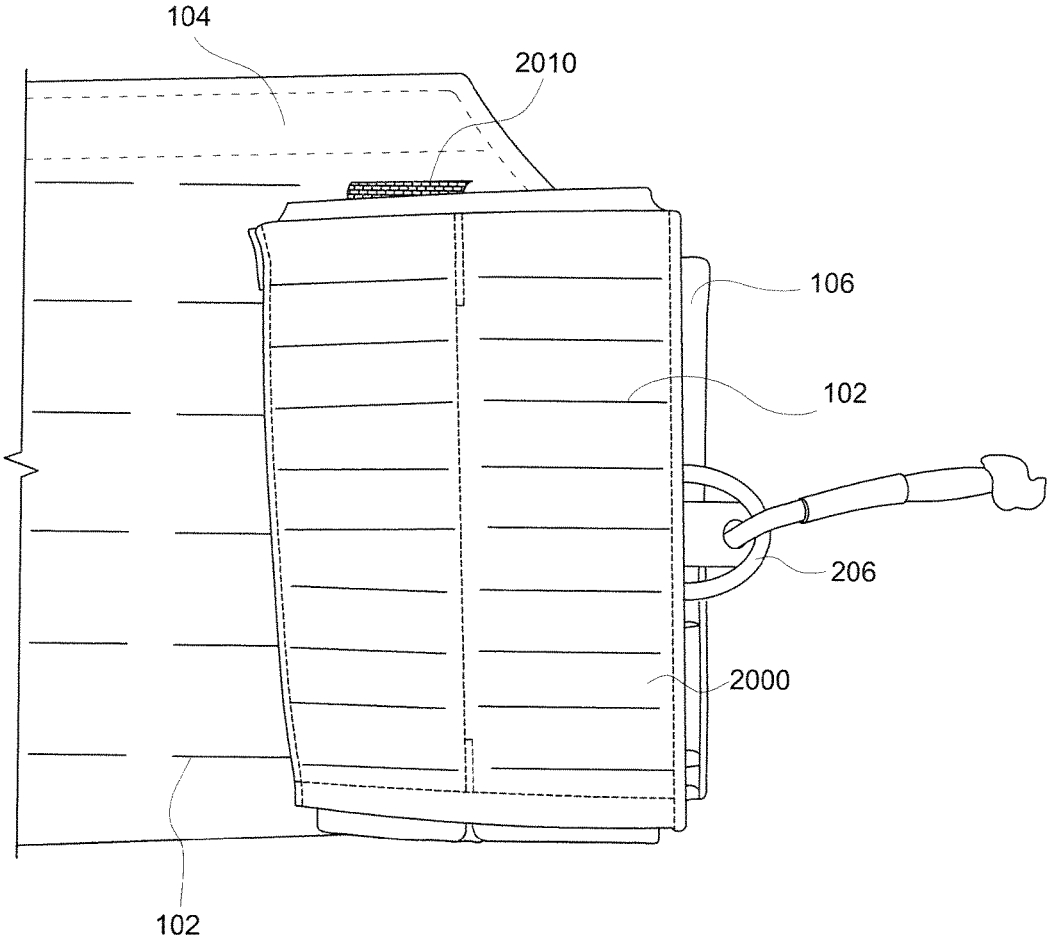
FIG. 20 illustrates an outer face view of an alternative fastening configuration for an attachment panel, in accordance with an embodiment of the present disclosure.
Figure 21:
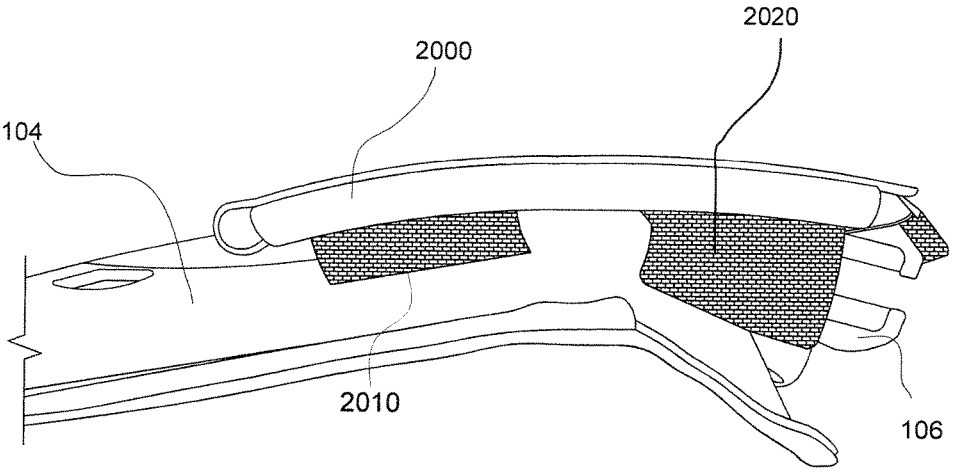
FIG. 21 illustrates a cross-sectional view of the alternative fastening configuration, in accordance with an embodiment of the present disclosure.
Figure 22:
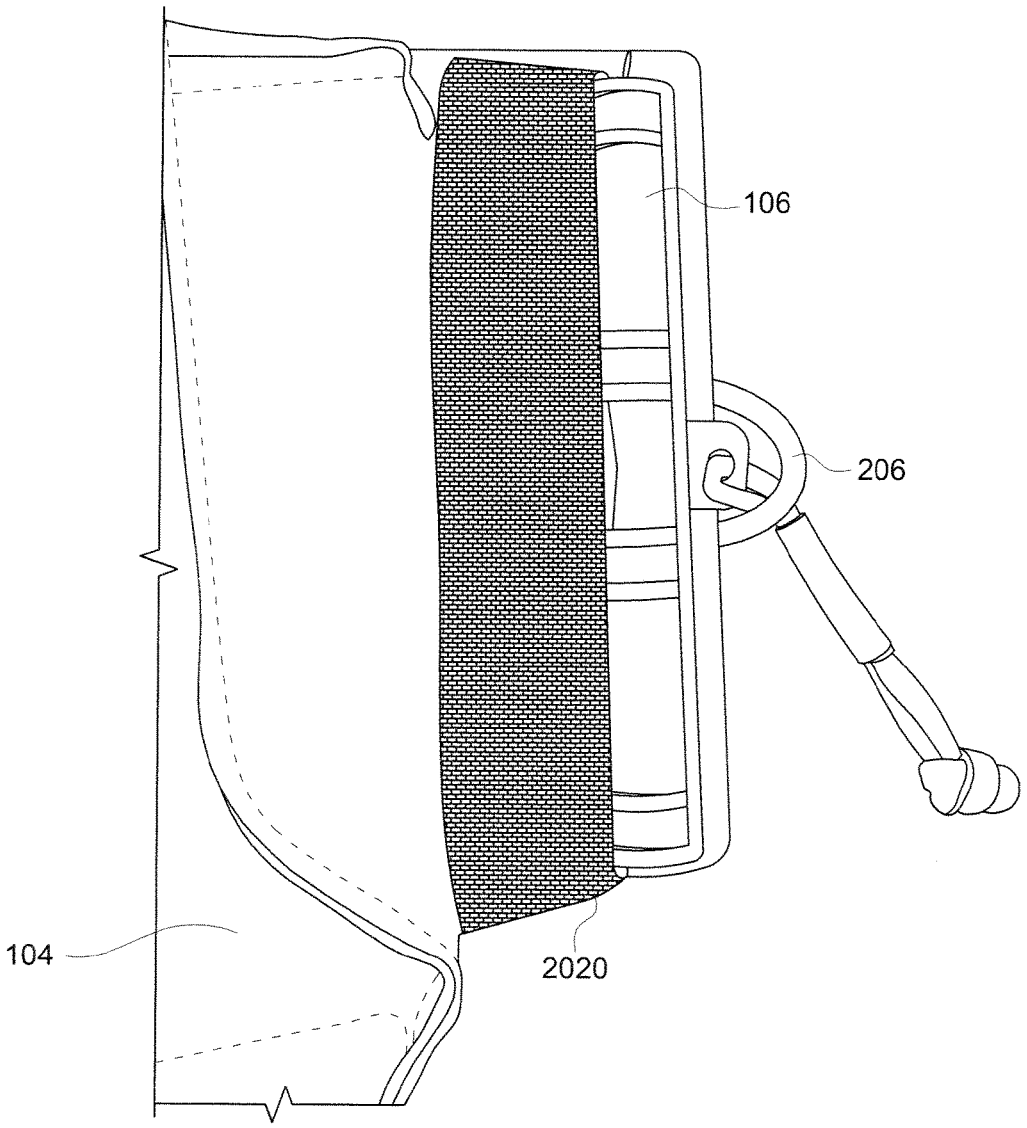
FIG. 22 illustrates an inner face view of an alternative fastening configuration for an attachment panel, in accordance with an embodiment of the present disclosure.

FIG. 20 illustrates an outer face view of an alternative fastening configuration for an attachment panel, in accordance with an embodiment of the present disclosure. According to an embodiment, an attachment panel (2000) may have one or more securing mechanisms for securing the attachment panel (2000) to a cummerbund (104). According to an embodiment, the attachment panel (2000) may or may not have a reinforcement structure (202) or a protective insert (820). The attachment panel (2000) may or may not have a loop (206) adapted to receive an unlocking cord of the release mechanism (106) in a manner that allows axial pull to the unlocking cord of the release mechanism (106). Although the release mechanism (106) appears to extend past the edge of the attachment panel (2000) and be exposed in FIG. 20, this is merely for illustrative purposes. According to an embodiment, the release mechanism (106) may be fully covered by the attachment panel (2000) similar to the embodiment illustrated in FIG. 11. FIG. 21 illustrates a cross-sectional view of the alternative fastening configuration, in accordance with an embodiment of the present disclosure. In the embodiment illustrated in FIG. 21, the securing mechanisms are strip (2010) and strip (2020). According to an embodiment, one end for each of strips (2010) and (2020) may be sewn or otherwise permanently fixed to the inner face of the attachment panel (2000). The free end of strip (2010) may wrap around the release mechanism (106) (as shown in FIG. 22) to keep the attachment panel (2000) from folding or flipping back and forth while in use. With regard to strip 2020, the free end may pass through webbing attachment points/slots (102) or a MOLLE grid similar to attachment strips (505) of FIG. 5 to be secured to the cummerbund (104). According to an embodiment, the slots (102) on the attachment panel (2000) may be horizontally aligned with the slots (102) of the cummerbund, chest rig or some other garment to which the attachment panel is fastened. Furthermore, although the horizontal spacing of slots (102) are not uniform all the way across from the cummerbund (104) to the attachment panel (2000) in FIG. 20, this is merely one embodiment for illustrative purposes. According to an embodiment, the slots (102) may be evenly spaced across the cummerbund (104) (or chest rig or some other garment) and attachment panel (2000) such that the transition from the cummerbund (104) (or chest rig or some other garment) to the attachment panel (2000) mimics a continuous MOLLE grid.

According to an embodiment, the attachment panel (2000) may be attached to a cummerbund (104) of FIG. 5 without permanently fixed or sewn strips (not illustrated) and use of securing mechanisms such as self-locking zip ties (to fasten permanently), reusable/releasable zip ties, polymer latching straps, rubber latching straps webbing, fabric, cord, elastic, hook and loop tape, Velcro Onewrap®, and/or a combination of strap mechanisms, such as cut fabric and/or laminate strips and/or webbing with or without triglide/slide and/or similar buckles and/or hardware or a plurality releasable and/or permanent latching mechanisms and such.

According to an embodiment, the attachment panel (2000) may have tunnels similar to tunnels (510) of FIG. 5 or cut slots similar to slots (812) that allow strips or zip ties to pass through in a snakelike manner.

Figure 23:
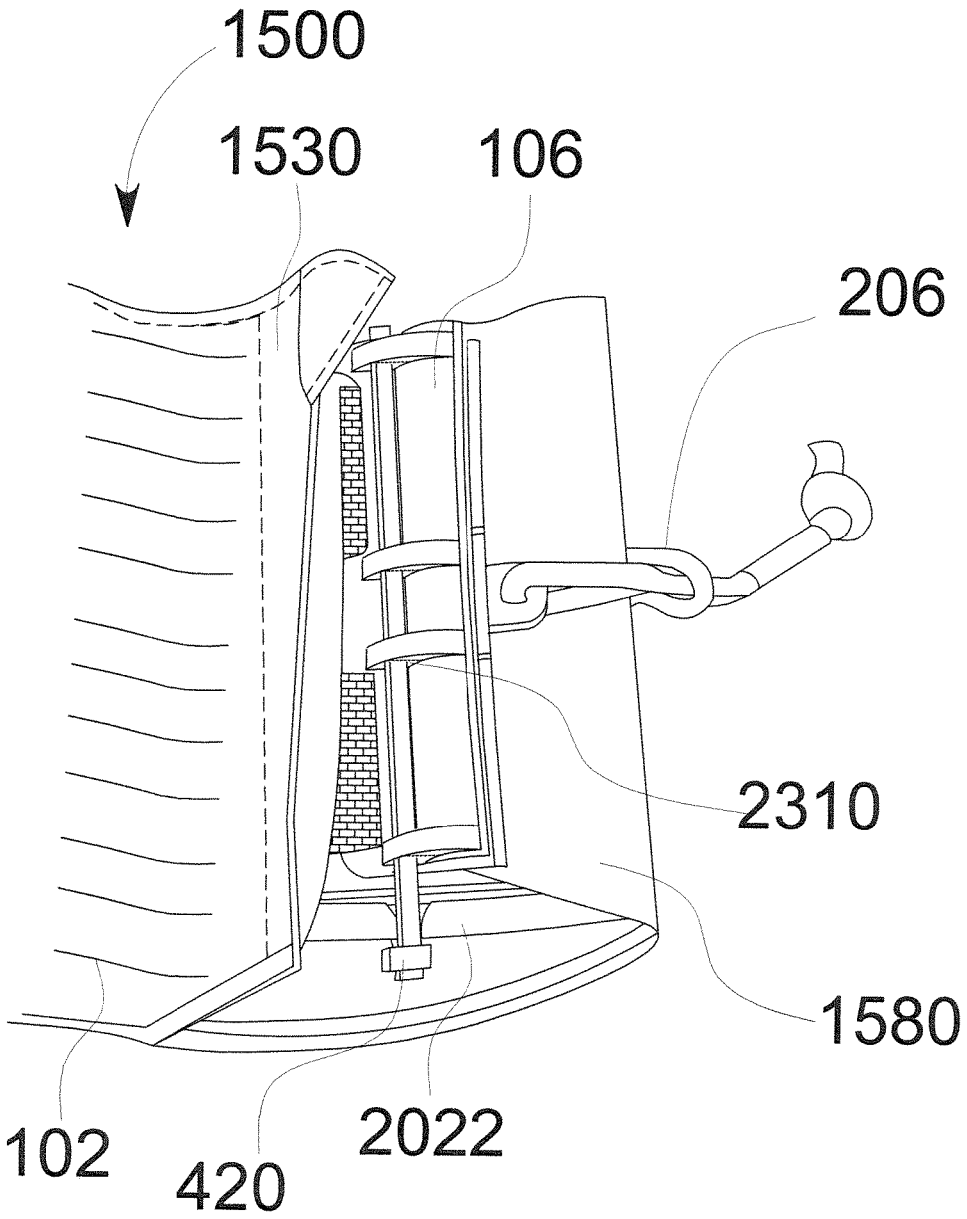
FIG. 23 illustrates the inner face (i.e. body side) of an attachment panel with passages molded into a release mechanism, in accordance with an embodiment of the disclosure.

FIG. 23. illustrates the inner face side (i.e. body side) (1530) with passages (2310) molded into a release mechanism (106), according to an embodiment of the present disclosure. The passages (2310) can be located on any of the surfaces of the release mechanism (106), internally or externally, and take on any of a plurality of geometries, lengths and cross-sectional shapes/areas. There could be multiple passages (2310) to allow for one or more securing mechanisms to be passed through. The molded passages may have a plurality of securing mechanisms made from a plurality of materials, geometries and sizes as previously disclosed passed through them in a plurality of configurations (e.g. snake-like manner and/or straight pass through). According to an embodiment, use of the passages (2310) molded to into a release mechanism (106) may allow the use of a single securing mechanism (420) to both fasten a panel to the release mechanism (106) and also help prevent the panel from folding back. One or more passages (2310) may be molded into a release mechanism (106). According to an embodiment, the passages (2310) allow for the securing mechanisms (420*a* and 420*b*) to fasten the previously disclosed embodiments of the attachment panel (200), (500), (800), (2000), integrated cummerbund (1500), attachment pouch (1900), and chest rig (1800) panel (1810) securely and help prevent them from wiggling, flipping, or folding back and forth, folding backwards and/or provide a stable and secure mounting platform over the release apparatus (106) through the methods previously disclosed for zip tie (420) securing mechanisms.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the disclosure is anticipated to hold on to all other such alternatives, modifications, and variations that fall within the scope of the present disclosure and appended claim.

The invention claimed is:

1. A panel configured to cover a release mechanism, that maintains a closed state when a garment is donned and releases to an opened state for doffing of the garment, and to enable mounting pouches and equipment thereon, the panel comprising:

a reinforcement structure;

a fabric wound over the reinforcement structure, the fabric comprising a plurality of mounting slots; and a first securing mechanism configured to secure the panel to the release mechanism of the garment such that the panel extends from an open end of the garment and enables mounting of pouches and equipment over an area covering the release mechanism.

2. The panel of claim 1, further comprising a vertical cavity for allowing the first securing mechanism to be tunneled through the outer face of the panel.

3. The panel of claim 2, further comprising a plurality of securing slots on the inner face of the panel for allowing passage of the first securing mechanism through the plurality of securing slots.

4. The panel of claim 3, further comprising a second securing mechanism for tunneling through the vertical cavity and fastening to the release mechanism to restrain the panel from folding back.

5. The panel of claim 1, further comprising a loop on an edge of the panel for allowing passage of a cord that is operatively coupled to the release mechanism.

6. The panel of claim 1, wherein the reinforcement structure comprises at least one elongated bar, the panel further comprising at least one tunnel-ended strip for fastening the at least one elongated bar to the garment, each tunnel-ended strip comprising:

a tunnel portion configured to wrap around a free end of an elongated bar that is extending out of the panel; and at least one strip configured to fasten to the garment.

7. The panel of claim 1, wherein the plurality of mounting slots form a MOLLE grid.

8. The panel of claim 1, wherein the plurality of mounting slots comprise one of sewn webbings and cut slots.

9. The panel of claim 1, wherein the garment comprises one of a cummerbund, a vest, a carrier, a plate carrier, and a chest rig.

10. The panel of claim 1, wherein the first securing mechanism comprises one of a strap and a zip tie.

11. The panel of claim 1, further comprising a protective insert underneath the fabric, the protective insert being composed of one of a rigid and semi-rigid material.

12. A garment includes a built-in panel configured to cover a release mechanism of a garment and to enable mounting pouches and equipment thereon, the garment comprising:

a main garment portion comprising a plurality of open end and a first plurality of mounting slots on an outer surface proximate to each of the at least one open end;

a release mechanism extending from an open end of the main garment portion and configured to maintain the garment in a closed state when donned and enable quick release to an opened state when being doffed; and the built-in panel incorporated into and formed to be an open end extending from the main garment portion, the built-in panel comprising a fabric comprising a second plurality of mounting slots, the built-in panel also covering the release mechanism such as to enable mounting of pouches and equipment over an area covering the release mechanism.

13. The garment of claim 12, wherein the built-in panel further comprises a reinforcement structure underneath the fabric.

14. The garment of claim 12, further comprising a securing mechanism that fastens the release mechanism to the built-in panel such that the built-in panel is restrained from folding back.

15. The garment of claim 12, further comprising a protective insert underneath the fabric of the built-in panel, the protective insert being composed of one of a rigid and semi-rigid material.

16. The garment of claim 12, further comprising a loop on an edge of the built-in panel for allowing passage of a cord that is operatively coupled to the release mechanism.

17. The garment of claim 12, wherein the first plurality of mounting slots of the main garment portion and the second plurality of mounting slots of the built-in panel each comprise at least one of sewn webbings and cut slots and together form a continuous MOLLE grid.

18. The garment of claim 15, wherein the release mechanism comprises at least one molded passage to allow the securing mechanism to pass through.

19. The garment of claim 12, wherein the garment comprises one of a cummerbund, a vest, a carrier, a plate carrier, and a chest rig.

20. The garment of claim 12, wherein the first securing mechanism comprises one of a strap and a zip tie.

* * * * *